United States Patent [19]

Saito

[11] 4,051,765

[45] Oct. 4, 1977

[54] ELECTRIC-HYDRAULIC PULSE MOTOR HAVING AN IMPROVED ROTARY GUIDE VALVE MEANS

[75] Inventor: Shoichi Saito, Karatsu, Japan

[73] Assignee: Nisshin Sangyo Co., Ltd., Tokyo, Japan

[21] Appl. No.: 692,021

[22] Filed: June 1, 1976

Related U.S. Application Data

[63] Continuation of Ser. No. 597,816, July 7, 1975, abandoned.

[30] Foreign Application Priority Data

July 23, 1974 Japan ..... 49-84906

[51] Int. Cl.[2] ..... F15B 21/02; F01B 3/10

[52] U.S. Cl. ..... 91/35; 91/482; 417/270; 418/61 B

[58] Field of Search ..... 91/35, 39, 499–507; 417/270, 222; 418/61 B

[56] References Cited

U.S. PATENT DOCUMENTS

| | | | |
|---|---|---|---|
| 3,074,345 | 1/1963 | Schoflow | 417/270 |
| 3,583,283 | 6/1971 | Cunningham | 91/35 |
| 3,752,038 | 8/1973 | Inaba | 91/39 |
| 3,828,400 | 8/1974 | Mason et al. | 91/497 |
| 3,908,517 | 9/1975 | Wonbounne | 91/497 |

FOREIGN PATENT DOCUMENTS

| | | | |
|---|---|---|---|
| 1,127,829 | 4/1962 | Germany | 91/482 |

*Primary Examiner*—William L. Freeh
*Attorney, Agent, or Firm*—Wenderoth, Lind & Ponack

[57] ABSTRACT

An electric-hydraulic pulse motor having an improved rotary guide valve means is provided. In the rotary guide valve, a valve member for controlling the supply of fluid to the hydraulic motor is adapted to be shifted for performing the controlling function by the effect of pressurized fluid. The valve member is supported on a valve shaft or a signal input shaft which is to be actuated by a conventional electric pulse motor or the like so that the valve member rotates with one of the two shafts but is allowed to be shifted transversely thereto to either of two eccentric positions by the effect of the pressurized fluid. Control for shifting the valve member is obtained by arranging the two shafts so that the relative movement between the two shafts controls the pressurized fluid so as to move the valve member to the desired one of the eccentric positions.

23 Claims, 26 Drawing Figures

Fig. 1
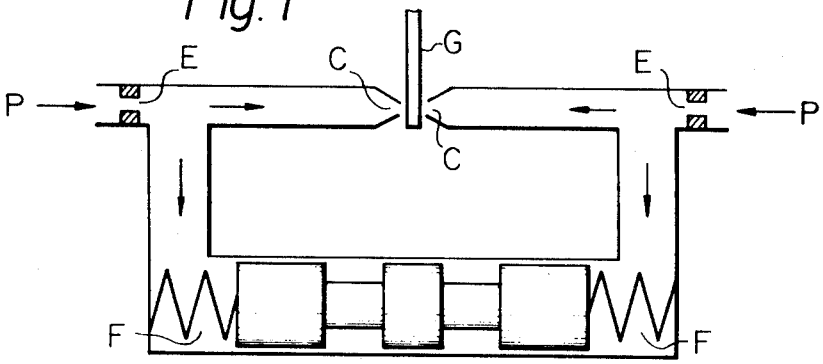
Fig. 2
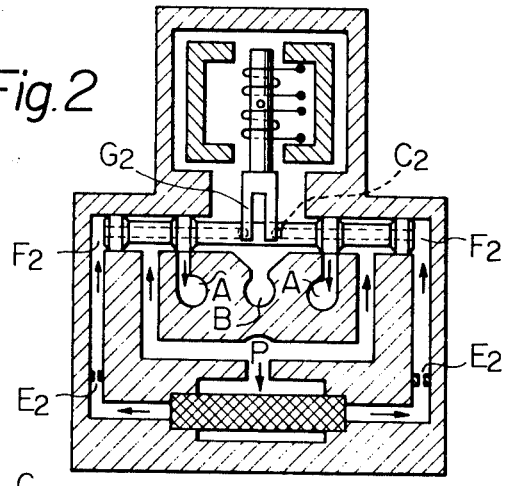
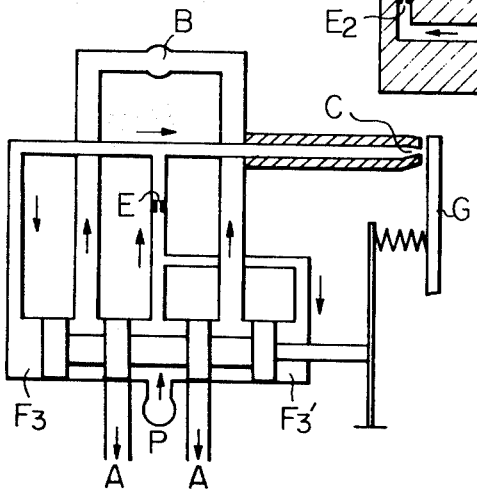
Fig. 3

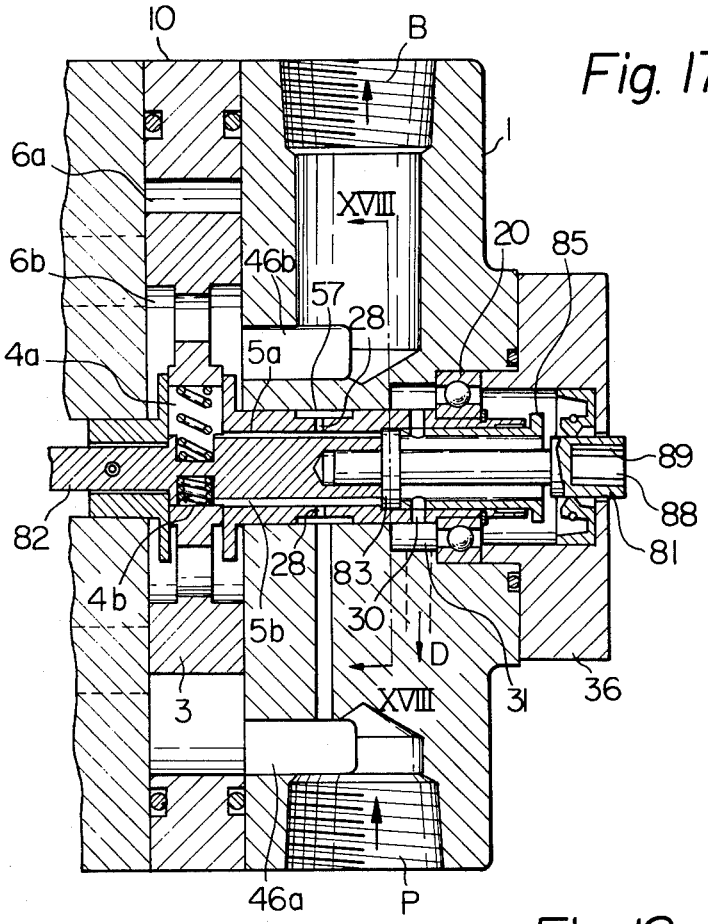
Fig. 17
Fig. 18
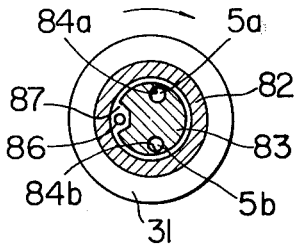

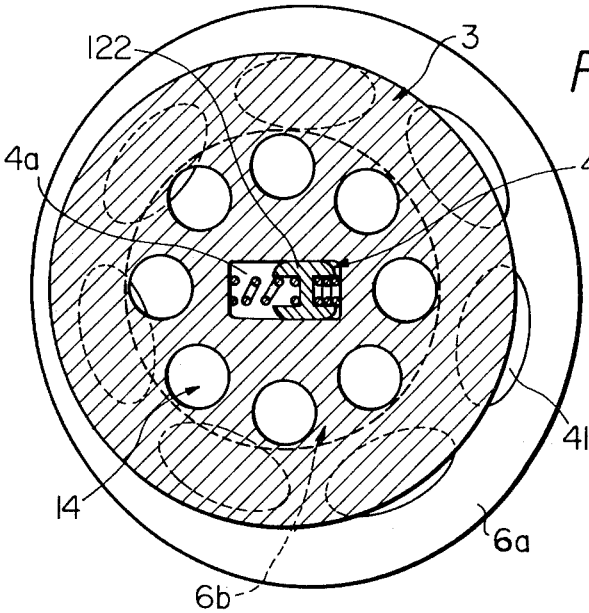
Fig. 23
Fig. 24
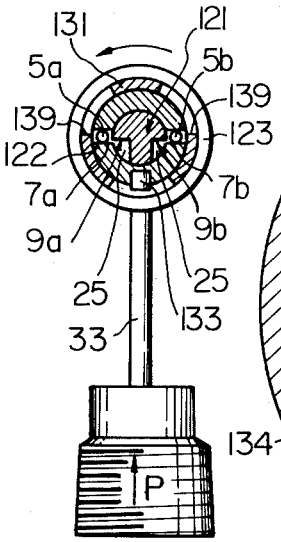
Fig. 25
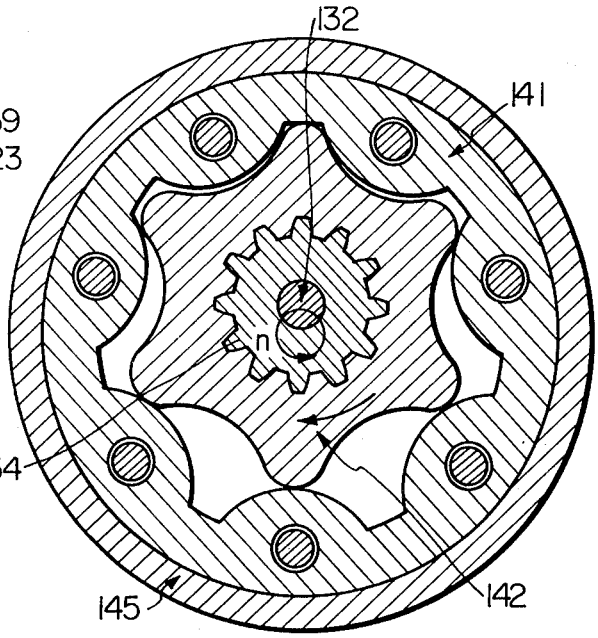

ELECTRIC-HYDRAULIC PULSE MOTOR HAVING AN IMPROVED ROTARY GUIDE VALVE MEANS

This application is a continuation of application Ser. No. 597,816 filed July 7, 1975 now abandoned.

This invention relates to a rotary type of fluid guide valve capable of providing a hydraulic motor in which an output rotation synchronous with any input rotation can be obtained. This invention is intended primarily to provide a feedback type hydraulic motor, namely an electric-hydraulic pulse motor in which a high power output rotation of an optional rate and direction can be obtained by connecting thereto an electric pulse motor as an input signal supply means.

The construction of some electric-hydraulic pulse motors has been well-known as shown, for example, in Japanese Patent Publications Nos. 6011/64, 25402/64 and 15390/65. However, no one is prefectly satisfied with the function required for the intended use. This is because in the structure of the known guide valves, a signal input must be supplied to directly actuate a valve spool. Since the output of a conventional electric pulse motor is not capable of actuating a relatively large valve spool, the valve spool in the known guide valves cannot control a large amount of flowing fluid. Japanese Patent Publication No. 25402/64 discloses one approach to resolve this problem, in which a first guide valve and a first hydraulic motor are so designed that they can be driven by an electric pulse motor; and the output shaft of the first hydraulic motor, which is capable of supplying a relatively large torque, is used as an input means for a second guide valve, which is similar to the first guide valve but has a larger capacity than the first guide valve, thereby obtaining a large torque or a high rate of rotation in the output shaft of a second hydraulic motor associated with the second guide valve. Thus, the structure shown in Publication No. 25402/64 is necessarily complicated. The structure shown in Japanese Patent Publication No. 15390/65 is another approach which seeks to resolve the aforementioned problem of a shortage in the amount of flowing fluid. In this structure, for avoiding the complication of the aforementioned structure, the rate of rotation of a rotary input of an electric pulse motor is reduced by gear means, thus concomitantly increasing the effective torque of the input. The rotary input is adapted to be changed to axial movement of a valve spool through a threaded portion formed on the spool, whereby a relatively massive valve spool may be shifted. This structure should be rated high in the sense that substantially the same effectiveness is obtained with fewer components than that of the previously explained structure. However, in this structure, the extent of movement of the valve spool is very small. Thus, a small amount of rotation of the input shaft is not sufficient to provide the necessary amount of flowing fluid. Generally, the step angle of the output shaft per each pulse is 2° or so in electric pulse motors used in such a structure. Thus, assuming that the pitch of the screw thread formed on the valve spool is 2 mm, the displacement of the valve spool per pulse is:

$$\frac{2(\text{step angle}) \times 2(\text{pitch of screw thread})}{360} = 0.011(\text{mm}).$$

This is a very small displacement. It is to be noted that, regardless of the structure of the guide valves, the amount of fluid flowing through a very narrow passage is naturally within a certain limit and a pressure loss is caused by the passage. Thus, if a great load is applied to the conventional electric-hydraulic pulse motor or if it is intended to obtain a high rate of rotation of the same, the hydraulic motor cannot follow the rotary signal input of the electric pulse motor, even with a certain lag, or the rate of rotation of the hydraulic motor varies according to the load variation. Thus, an output rotation completely synchronous with the signal input has not been obtained. As described above, although the conventional electric-hydraulic pulsemotors generally perform the intended functions, the operation thereof is not fully satisfactory.

Thus, the object of the present invention is to resolve the aforementioned problems in the conventional electric-hydraulic pulse motors, namely to adapt an electric-hydraulic pulse motor so as to obtain an output with a high rate of rotation and a large torque, thereby enlarging the scope of use thereof.

It is mandatory for achieving the object stated above to provide a structure in which a guide valve can instantaneously respond to an input of a slight torque. For providing such a structure in the present invention, pressurized fluid is supplied to a valve member so that the valve member can be indirectly actuated by the input means by controlling the fluid supplied to the valve member. In other words, in the present invention, the guide valve itself is constructed based on the principle of a hydraulic servo valve.

The other objects and features of the present invention will be apparent from the following detailed description of the preferred embodiments referring to the accompanying drawings, in which:

FIGS. 1-3 are diagrammatic illustrations of hydraulic servo valves for explaining the principle of the hydraulic servo valve;

FIG. 17 is a sectional view of still another embodiment of the invention;

FIG. 18 is an illustration of a primary portion in the sectional view taken along the line XVIII—XVIII in FIG. 17;

FIG. 23 is a sectional view taken along the line XXIII—XXIII in FIG. 22;

FIG. 24 is an illustration of the primary portion in the sectional view taken along the line XXIV—XXIV in FIG. 22;

FIG. 25 is a sectional view taken along the line XXV—XXV in FIG. 22.

Figure 4:
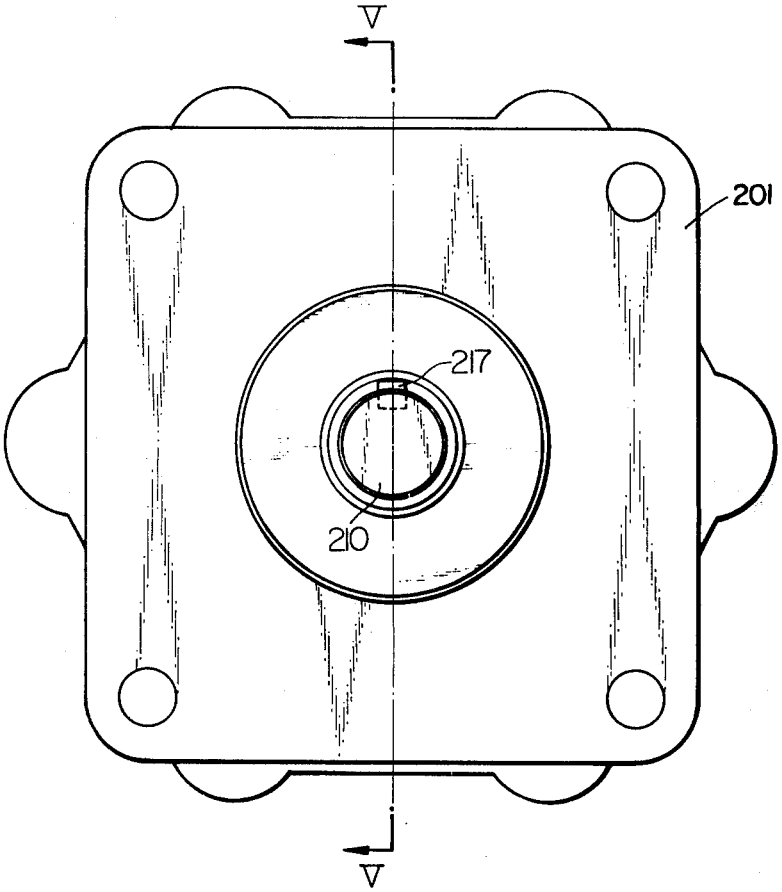
FIG. 4 is a front elevational view of the first embodiment of the invention.

Before describing the embodiments of the present invention, the principle of the invention will be briefly explained, referring to the simple diagrammatic illustrations shown in FIGS. 1–3, so that the structure and operation of the embodiments can be accurately understood.

FIG. 1 shows a basic form of a hydraulic servo valve in which pressurized fluid is supplied to valve chambers F at the opposite ends of a valve spool through passages having throttle portions E. Nozzle C is provided in communication with each chamber F. Flapper G is provided between nozzles C for establishing resistance to the fluid spouting from the nozzles. Flapper G is adapted to slightly move laterally, as viewed in FIG. 1, in the space between the nozzles generally by a magnetic attractive force caused by a torque motor, thereby varying the flow rates of the fluid spouting from the nozzles, respectively, toward each other. Thus, the pressure in the nozzle which is closer to the flapper than the other nozzle is increased, whereas the pressure in the other nozzle is decreased. Thus, the valve spool is shifted in one direction by the differential pressure acting on the opposite ends thereof.

FIG. 2 shows a modification of the form shown in FIG. 1. The structure in FIG. 2 differs from that of FIG. 1 in the following points. Firstly, instead of the nozzles, two ports $C_2$ are formed in a valve spool and connected to valve chambers $F_2$ through axial passages formed in the valve spool along the center axis thereof. Secondly, instead of the flapper, closure plates $G_2$ integrally connected to an armature of a torque motor for rotation therewith are provided. The structures in FIGS. 1 and 2 are equivalent in the sense that the valve spool is actuated by the differential pressure acting between the opposite ends thereof; the throttle portion is formed in the passage connecting a source of pressurized fluid to each end of the valve spool; and the variable throttle is provided for discharging a certain portion of the fluid acting on each end of the valve spool.

FIG. 3 shows another form of the hydraulic servo mechanism which differs from the structures of FIGS. 1 and 2 in the points that the pressure in one valve chamber $F_3'$ at one end of a valve spool is not controlled, and the pressure in the other valve chamber is controlled in the manner similar to those in FIGS. 1 and 2.

In FIGS. 1–3, P indicates passages communicating with the source of the fluid, A indicates return passages, and B indicates drain passages.

In the hydraulic servo valve structures shown in FIGS. 1–3, a slight displacement of flapper G or a member having closure surfaces, which functions equivalent to the flapper, varies the pressure in the valve chambers at the opposite ends of the valve spool contrarily to each other, namely increases the pressure in one of the chambers and decreases the pressure in the other. Since the pressure in the chambers varies contrarily to each other, the differential pressure becomes very great, whereby a massive spool for a large capacity guide valve can be easily actuated. Since the large differential pressure can be instantaneously caused by slight displacement of signal input means, the valve spool can operate by instantaneously responding to the input signal. Furthermore, since the flow rate of liquid spouting from the nozzles or the like in the hydraulic servo valves in FIGS. 1–3 is very low, resistance against the signal input means is naturally very small. Thus, a massive valve spool designed for a large capacity guide valve can be instantaneously moved a relatively large distance, thereby allowing a large amount of fluid to flow through the guide valve.

If the structure explained referring to FIGS. 1–3 is changed so that an output shaft of an electric pulse motor formed with suitable closure means can be used as the signal input means instead of the flapper or the like, a guide valve will be obtained in which a slight movement of the output shaft of the pulse motor, namely movement corresponding to a step angle per one pulse of the output shaft with a low torque, is sufficient for obtaining the intended actuation of the guide valve. This invention is intended to provide such a guide valve.

Although in the following description of the embodiments of the invention an electric pulse motor is used as signal input means, it should be understood that the signal input means is not limited to the electric pulse motor. Any other suitable means may be used therefor without departing from the scope of the invention.

FIGS. 4–13 show a structure of a typical embodiment of the present invention. As is obvious in the drawings, the structure includes a hydraulic motor formed in a base structure 201 and a cylinder case 202, and the rotary type fluid guide valve, to which the present invention is directed, formed in casing 10 and valve housing 1. In this embodiment, a hydraulic motor to be connected to the guide valve of the present invention comprises a plunger type motor including ten plungers 204, although the hydraulic motor is not limited to such concentration in the present invention. Each plunger is received in cylinder member 203 fitting in a cylinder chamber, and the plungers are disposed in a circular pattern, the center of which is on the center axis of principal shaft 210 of the motor in cylinder case 202. Cylinder case 202 and base structure 201 are secured to each other by bolts 215. Base structure 201 has a flange on the outer periphery thereof, holes for receiving bolts and a seat at the front end thereof which facilitates mounting various devices thereon. The inner end of the base structure 201 is adapted to form an oil cover portion retaining oil seal 211 between the cover portion and principal shaft 210 passing through the cover portion. Base structure 201 retains at the inside thereof the outer race of roller bearing 212 supporting principal shaft 210 of the motor, so that the axis of the shaft accurately coincides with the center axis of the major portion of the entire structure. The inner race of the roller bearing supports one of the journal portions of shaft 210 fitting therein. The axial movement of the inner race of roller bearing 212 is arrested by stop ring 213, which engages the associated side surface of the flange formed on principal shaft 210 of the motor. The other journal portion of motor shaft 210 is positioned and supported at the center of the entire structure by tapered roller bearing 214 mounted in the central portion of cylinder case 202. The axial movement of bearing 214 is arrested by the engagement with the side surface of the stepped portion on the principal shaft. Oblique flange member 205 is provided in the hollow portion in base structure 201. The oblique flange member is fixed by a key 206 to principal shaft 210 for rotation therewith. The oblique flange member is so formed that the surface facing the front of the motor is normal to the principal shaft. The oblique flange member is supported on principal shaft 210 in contact with the flange formed on the principal shaft. Stop ring 209 supported on shaft 210 engages the other end of the oblique flange member for arresting the axial movement of the flange member.

Oblique flange member 205 is fixed to shaft 210 to rotate with the shaft by means of the key 206 interposed between flange member 205 and principal shaft 210. The axial force exerted by the hydraulically driven plungers 204 is absorbed by thrust bearing 207 which is seated on the inner surface of base structure 201 and one of the rings of which is fixed to the front face of oblique flange member 205. Another thrust bearing 208 is provided on the oblique surface facing plungers 204 for relieving frictional force caused by axial movement of plungers 204. The outer end of the principal shaft functions as an output shaft of the hydraulic motor. It projects forwardly of the motor and is provided with key 217 for having a gear or the like mounted thereon and preventing the same from relative rotation to the shaft. The other end of principal shaft 210 of the motor is provided with a hole having a key way for connection with the aforementioned principal shaft of the fluid guide valve.

Figure 5:
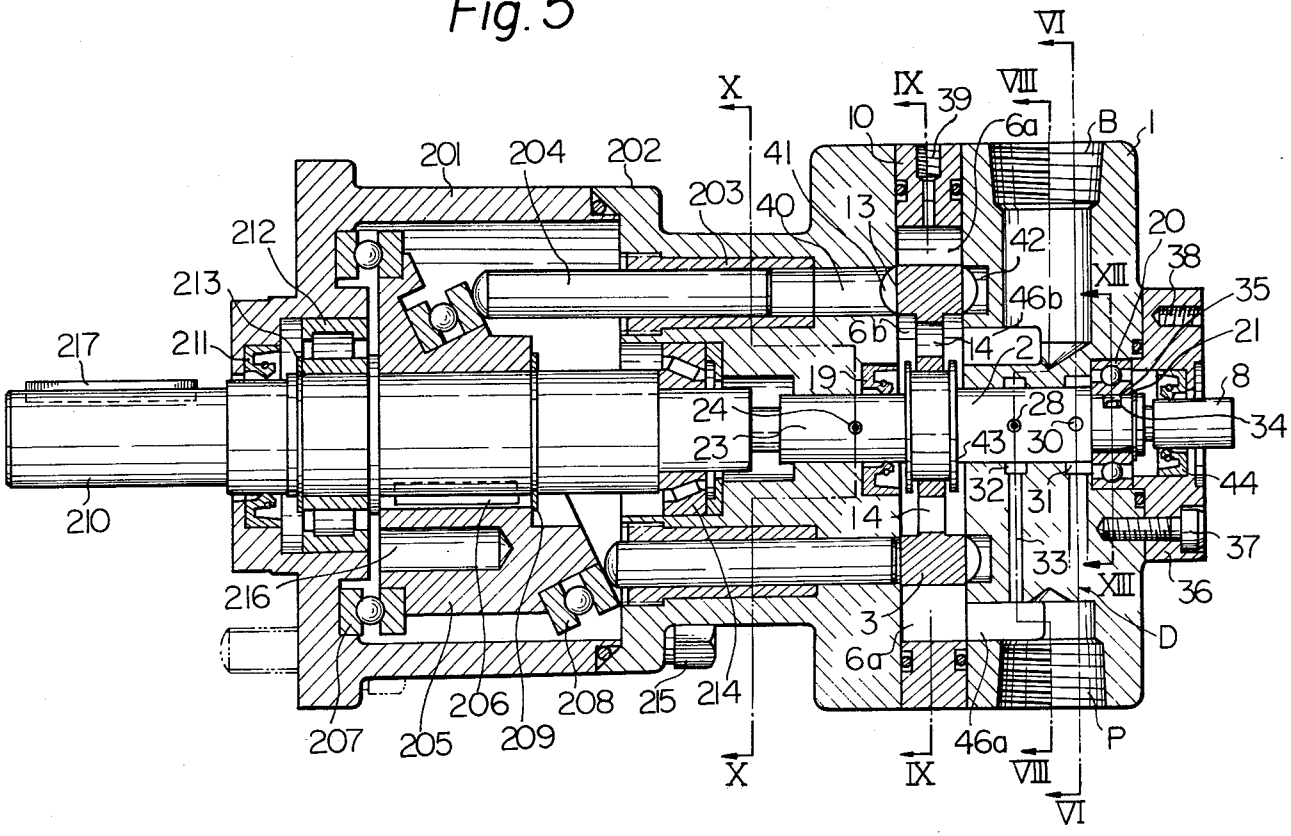
FIG. 5 is a sectional view taken along the line V—V in FIG. 4.
Figure 11:
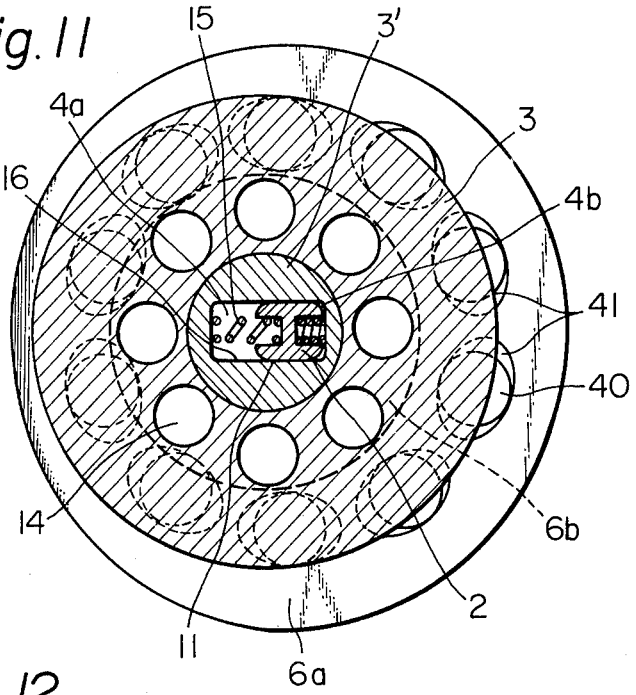
FIG. 11 is an illustration of a portion of FIG. 9 with the valve plate therein shifted.
Figure 12:
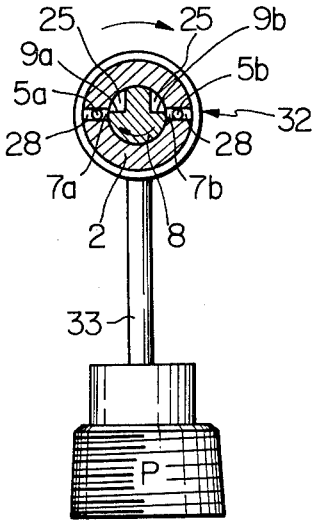
FIG. 12 is an illustration of a portion corresponding to the primary portion of FIG. 8.
Figure 13:
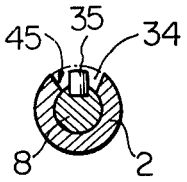
FIG. 13 is an illustration of a portion of the sectional view taken along the line XIII—XIII in FIG. 5.

Cylinder case 202 forming the rear portion of the hydraulic motor is provided with a hole at the center thereof for supporting one end of principal shaft 2 of the valve. The hole contains oil seal 19. As is shown in FIGS. 5 and 11, end portion 41 of valve bore 40 which forms a continuous extension of each cylindrical chamber is elongated in a direction perpendicular to an imaginary line radially extending from the center of principal shaft 2 of the valve so as to give the cross-section of the end portions 41 the shape of an ellipse. A tapered or hemispherical recess is formed by scooping out the material around the end portion of each valve bore. Reference 216 designates a hole formed in oblique flange member 205 for weight balance thereof.

Figure 9:
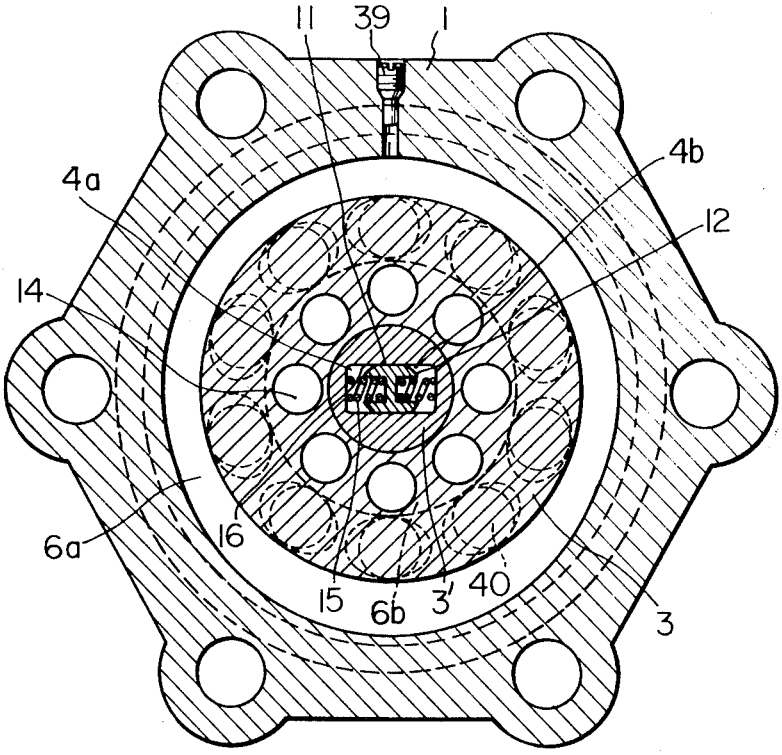
FIG. 9 is a sectional view taken along the line IX—IX in FIG. 5.
Figure 10:
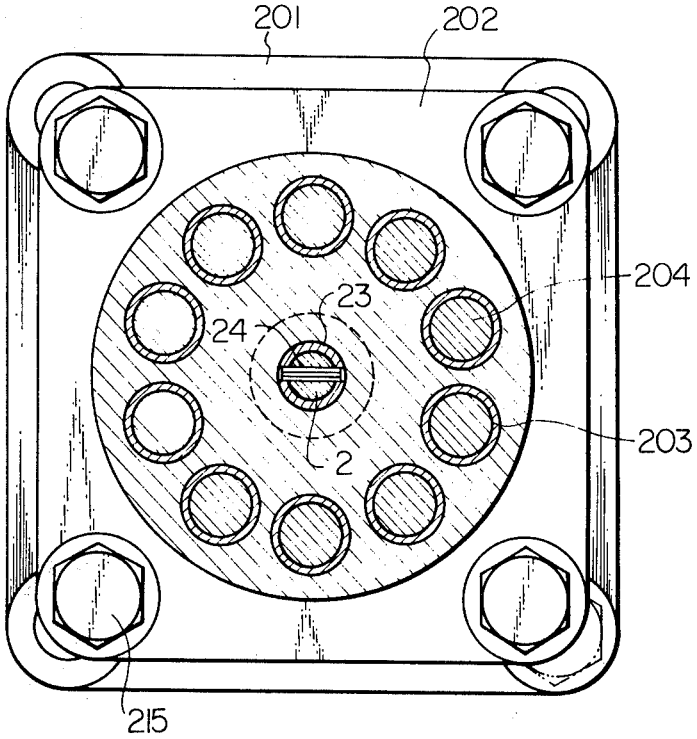
FIG. 10 is a sectional view taken along the line X—X in FIG. 5.

The structure of the rotary type fluid guide valve, which is the subject matter of the present invention, will now be explained. The fluid guide valve is connected to the rear portion of the hydraulic motor with one of the end surfaces of the valve being defined by the rear end surface of cylinder case 202. Casing 10 is provided as a means for defining valve chamber 6 and adjusting the thickness thereof. Valve housing 1 is connected to the rear portion of the casing 10. The valve housing defines one of the side walls of valve chamber 6 and has a center hole which functions as a port communicating with a fluid supply as well as acting to support the other end of principal shaft 2. Above-mentioned cylinder case 202, casing 10 and valve housing 1 are integrally connected to each other by bolts 17 which are inserted at the outer surface of the valve housing and threaded into associated tapped holes in cylinder case 202. The inner end of valve shaft 2 supported by the cylinder case is adapted to fit in the center bore in motor shaft 210 and is keyed thereto for common rotation with shaft 210. A portion of valve shaft 2 in valve chamber 6 is provided with flange 43 at a position adjacent valve housing 1. The intermediate portion of the valve shaft portion in valve chamber 6 is shaped in a non-circular configuration having two parallel sliding surfaces 11 and having bores 12 for receiving coil springs, which bores extend from the cylindrical surfaces other than the sliding surfaces towards the center of the shaft (FIGS. 9 and 11). Mounted on the valve shaft 2 and secured thereto by a suitable screw is closure member 23 which has a flange portion in the valve chamber 6 adjacent cylinder case 202 to form a predetermined space between itself and flange 43. For preventing the securement of the closure member to the valve shaft from getting loose, spring pin 24 is used. Cam member 3' is carried on the valve shaft at the position between flange 43 and the flange portion of closure member 23. Cam member 3' has a generally rectangular opening having sliding surfaces 16 slidably engaging the two parallel sliding surfaces 11 of the non-circular portion of principal valve shaft 2. The cam member and the non-circular portion of the principal valve shaft are so arranged that the forces of coil springs 15 are applied to the surfaces in the openings which are perpendicular to the sliding surfaces 16 to yieldably position the cam member in a position coaxial with the principal shaft valve. Principal valve shaft 2 divides the generally rectangular opening into two variable fluid chambers **4*a* and 4*b*. Valve plate 3 is fitted on the periphery of cam member 3'. The valve plate is provided with a hole for receiving the cam member, annular closure surfaces 13 for closing valve bores 40 communicating with the hydraulic motor and counter bores 6*b* in the opposite sides thereof, and a suitable number of holes 14 establishing communication between the counter bores. Conduits 5*a*, 5*b* provided in the rear portion of principal shaft 2 having flange 43 and extending parallel to the axis of shaft 2 open into each of the two variable size fluid chambers 4*a* and 4*b* formed by dividing the opening in cam member 3' by principal shaft 2. As has been previously mentioned, principal valve shaft 2 is connected to principal motor shaft 210 by inserting the end thereof adjacent the hydraulic motor in the hole of shaft 210 and securing shaft 2 to shaft 210 by key 18. The inner race of ball bearing 20 is mounted on the other end of shaft 2 at a reduced diameter portion. The axial movement of bearing 20 is arrested by the stepped portion on shaft 2 and stop ring 21. The rear portion of shaft 2 is provided at the center portion thereof with axial bore 22 extending from the end face of shaft 2 for movably receiving signal input shaft 8. The diameter of an intermediate portion of the length of the input shaft is reduced and the forward end portion of the input shaft is provided with two axial guide grooves 25. The rear end of the input shaft is provided with axial bore 26 for receiving a primary input shaft such as an output shaft of an electric pulse motor. The bore 26 has key way 27 for preventing the relative movement with respect to an associated shaft. Principal shaft 2 is further provided with passages 7*a* and 7*b*, each of which communicates with variable volume fluid chambers 4*a* and 4*b* through conduits 5*a* and 5*b*, respectively, and which are adapted to be closable by closure surface 9*a* or 9*b* on the front portion of signal input shaft 8. Fixed throttles 29 are formed in passages 7*a* and 7*b* at the positions adjacent the outer periphery of shaft 2 for controlling the volume of fluid supplied to variable fluid chambers 4***a* and 4*b*. It will be appreciated that the ends of passages 7*a* and 7*b* opening into the axial bore in shaft 2 are adjustably closed by closure surface 9*a* and 9*b* for controlling the rate of fluid spouting from passages 7*a* and 7*b*. Thus, valve shaft 2 and input shaft 8 cooperate to form variable throttles capable of controlling the rates of fluid spouting from passages 7*a* and 7*b*. Guide grooves 25, provided primarily for forming the closure surfaces on the front portion of input shaft 8, function also as fluid passages for guiding the fluid spouting from passages 7*a* and 7*b* along the intermediate portion of input shaft 8. Passages 7*a* and 7*b* communicate through grooves 25 with drain port D through radial passages 30 formed in principal shaft 2 which open into annular space 31 encircling reduced diameter portion 29 of the input shaft. It is so arranged that pressurized fluid is always supplied to the outer ends of passages 7*a* or 7*b* or fixed throttles 28 through an annular groove formed in the wall of the axial bore of valve housing 1 at the position corresponding to the passages. Reference number 33 indicates a passage connecting supply port P to annular groove 32 for supplying the pressurized fluid to fixed throttles 28. In FIG. 5, reference number 42 indicates pressure compensating recesses opposed to valve bores 40 communicating with the hydraulic motor at the positions in the side wall of valve housing 1 aligned with valve bores 40. At the position where the principal shaft of the valve or valve shaft is supported by ball bearing 20, stop pin 35 is provided for preventing input shaft 8 from coming off the principal shaft and effecting a screw-like movement. At the place corresponding to the stop pin, openings 34 are formed in principal shaft 2 to form a stop surface 45. Cover member 36, which is attached to the rear face of valve housing 1 by bolts 37, functions to support the signal input means of an electric pulse motor or the like as well as to retain bearing 20. The cover member also functions as sealing means, holding oil seal 44 interposed between itself and input shaft 8. Reference number 38 indicates tapped holes formed in the cover member for securement of signal generating means. A vent opening is formed in casing 10 at the top thereof for releasing air and has plug 39 threaded thereinto.

Upon connecting the hydraulic motor and the fluid guide valve, the direction of the eccentricity between oblique flange member 205 and valve plate 3 carried on principal valve shaft 2, and the relation between input shaft 8 and ports 7*a* and 7*b*, namely the relation between the direction in which shaft 8 is rotated and the tendency of ports 7*a* and 7*b* to be opened or closed thereby, are very important. For example, the direction in which oblique flange 205 and valve plate 3 are eccentric to each other should be perpendicular to the direction of the maximum inclination of oblique cam member (namely it should be parallel with the plane of FIG. 7). In such case, the inlet and outlet side of the hydraulic motor should be selected so as to make the rotational directions of motor shaft 210 and input shaft 8 the same. In such situation, the effective opening at the inner end of each port 7*a* and 7*b* should be varied by the rotation of input shaft 8 so that one of the fluid chambers expands to cause a desired shifting of the cam member. Although they are not shown in the drawings, O-rings are used at places at which leakage of oil is expected.

In summary, the aforementioned embodiment comprises the fluid guide valve including valve shaft 2 which rotates integrally with the hydraulic motor and provides a feedback of the rotation of the hydraulic motor to the fluid guide valve; valve chamber 6 defined by the opposite side walls and the ring-like member concentric with shaft 2; and cam member 3' provided with a generally rectangular opening having the sliding surfaces engaging the sliding surfaces formed on valve shaft 2 at the portion in said valve chamber 6, said sliding surfaces on shaft 2 also functioning to arrest the rotation of the cam member relative thereto, thereby allowing movement of the cam member towards the eccentric position without changing the relative angular position to shaft 2. The opening in the cam member is divided into two chambers 4*a* and 4*b* which function as variable volume fluid chambers to which pressurized fluid is supplied. The control means is provided, which restricts the flow of the fluid supplied to the variable volume fluid chambers and the flow of the fluid spouting from said variable volume fluid chambers, and is so adapted that it can vary the flow rate of the fluid spouting from the chambers. The cam member and the valve plate supported by the cam member are adapted to be shifted by differential pressure working between the two variable volume fluid chambers. The variable volume fluid chambers of the present invention correspond to the valve chamber of the aforesaid spool type servo valve and the cam member including the valve plate of this invention is a guide valve member corresponding to the spool of the aforesaid servo valve. It is to be understood that the present invention is constructed according to the same requirements as those for the principle of the spool type servo valve in the sense that the throttle is provided in the inlet passage of the variable volume fluid chamber and the control means is provided in the outlet passage of the same for varying the rate of the outlet flow from the fluid chamber according to the input signal. It should also be understood that a feature of the present invention is in the fact that the servo valve is modified so that it is used in a rotary structure and adapted to respond to a rotary input. In the aforementioned structure of the present invention, it should be understood that sliding surfaces 11 are not limited to those on the non-circular cross-section shaft portion so long as they function as means on which the cam member slides and work to determine the angular position of the cam member relative thereto. For example, although it is not shown in the drawings, the same purpose can be achieved by providing a guide stud in the opening of the cam member so that the guide stud extends in the direction of the shifting of the cam member and adapting the guide stud so as to be slidably received in a hole laterally extending through the principal shaft of the valve.

In the embodiment described hereinabove, reference P indicates a fluid supply port and B indicates a discharge port. Communication chamber 46*a* is provided between port P and valve chamber 6*a*, and communication chamber 46*b* is provided between port B and valve chamber 6*b*.

Figure 6:
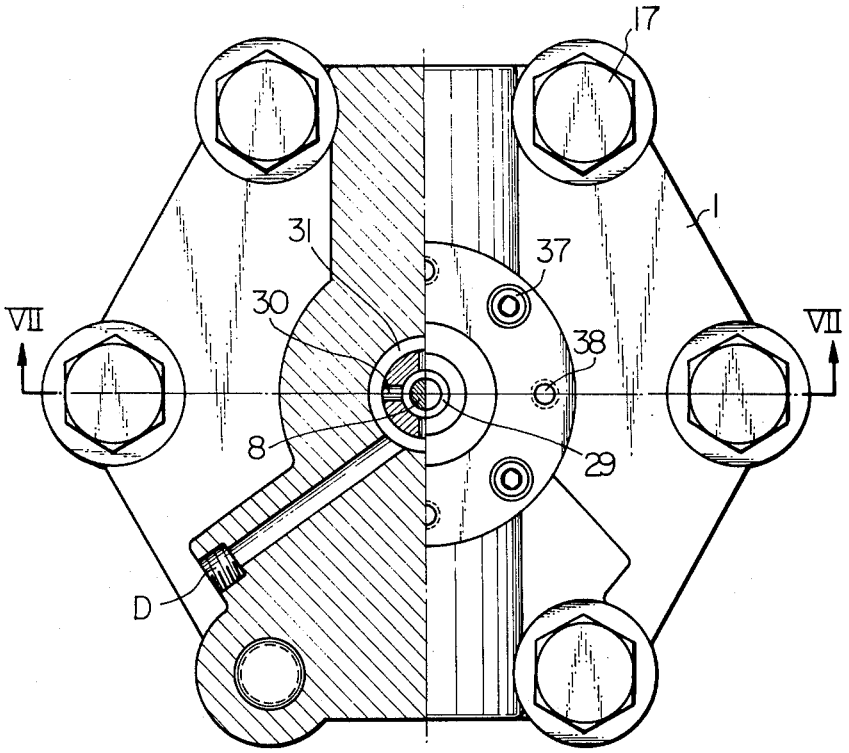
FIG. 6 is a rear elevational view of the first embodiment, partially in section, taken along the line VI—VI in FIG. 5.

The operation of the embodiment described hereinabove will be made clear by the following description. When pressurized fluid is supplied through port P to the apparatus of this invention, it is fed to annular groove 32 encircling principal shaft 2 of the valve through passage 33 as well as to outer valve chamber 6*a* which is formed by dividing the valve chamber by the portion of valve plate 3 forming closure surface 13. Then the pressurized fluid supplied to groove 32 is fed to variable volume fluid chambers 4*a* and 4*b* in the cam member through throttles 28 provided in the outer ends of passages 7*a* and 7*b*, and a portion of the pressurized fluid is discharged from the inner ends of passages 7*a* and 7*b* with the discharged fluid being adjustably restricted by closure surfaces 9*a* and 9*b* of signal input shaft 8, thereby controlling the pressure in the variable fluid chambers. The fluid discharged from the inner ends of passages 7*a* and 7*b* flows along the intermediate portion of the input shaft through guide grooves 25 formed in the input shaft and further flows to drain port D through radial holes 30 formed in valve shaft 2 (FIG. 6).

With the pressurized fluid flowing as described above, if input shaft 8 is rotated, the angular position of input shaft 8 relative to principal shaft 2 varies, and, accordingly, the effective opening areas of passages 7*a* and 7*b* vary oppositely to each other. For example, if input shaft 8 is rotated clockwise as suggested in FIG. 12, the effective opening area of passage 7*a* is descreased, while that of the other passage 7*b* is increased. Thus, the pressure in variable fluid chamber 4*a* communicating with passage 7*a* is increased, while the pressure in the other chamber 4*b* is decreased, thereby creating differential pressure between the two fluid chambers. By such operation of the fluid, cam member 3′ and the valve plate carried thereon moves so that the center thereof moves in the direction of variable fluid chamber 4*a* in which the pressure is increased, whereby the eccentric position is established.

As is obvious from FIG. 11, if valve plate 3 is shifted to the eccentric position, valve bores 40 at the side from which the valve plate moves away open to outer valve chamber 6*a* encircling the outer periphery of valve plate 3, whereas valve bores 40 at the side toward which the valve plate moves open to inner valve chamber 6*b*. As is already described, inner valve chamber 6*b* is obtained by forming in valve plate 3 two counter bores in the opposite side walls thereof and communication bores 14 between the counter bores. In the eccentric position, the inner valve chamber communicates with discharge port B through chamber 46*b*. Thus, in this position, the supplied fluid is fed to bores 40 which open to outer valve chamber 6*a* and acts on the inner ends of plungers 204 received therein, whereas from bores 40 opening to inner valve chamber 6*b*, the fluid is discharged to port B.

By the effect of the fluid, plungers 204 in valve bores 40 opening to outer valve chamber 6*a* (that is, bores shown in the right side of FIG. 11) are driven, thereby causing rotation of oblique flange member 205 in the direction determined by the direction of the slope thereof and applying torque to principal shaft 210 of the motor. As is obvious from FIGS. 5 and 11, the rotational direction of shaft 210 is the same as that of input shaft 8 indicated by the arrow in FIG. 12, and thus the rotation of the principal valve shaft 2 caused by motor shaft 210 follows the rotation of input shaft 8 in the same direction. When input shaft 8 is stopped, the relative angular position between the input shaft 8 and valve shaft 2 returns to the initial position, thereby releasing the aforesaid differential pressure between fluid chambers 4*a* and 4*b*. Thus, valve plate 3, which follows the cam member, returns to the initial or central position in valve chamber 6*a*, 6*b*, whereupon the valve plate closes again the bores 40 to stop the motor shaft. If input shaft 8 is assumed to be continuously rotated, plungers 204 are continuously driven by the aforementioned effect of the fluid to cause continuous rotation of the motor shaft following input shaft 8. If input shaft 8 is rotated in the direction opposite to the aforedescribed direction, the fluid inversely effects a shift of valve plate 3 to the other eccentric position opposite to the previously described eccentric position, thereby rotating motor shaft 210 in the opposite direction.

The present invention provides a hydraulic motor which can be rotated synchronously with a signal input shaft by the effect of fluid as described above. The invention also involves special means for resolving some problems in the operation of the hydraulic motor.

Firstly, valve plate 3 is relatively rotatably mounted on cam member 3′. Thus, when cam member 3′ is rotated integrally with valve shaft 2, relative velocity between valve plate 3 and the side walls of valve chamber 6*a*, 6*b*, which frictionally engage with each other, is reduced since relative sliding movement occurs between the outer periphery of cam member 3′ and the inner periphery of the center bore of valve plate 3. However, this structure is only a preferred form of the invention. It should be understood that the principal object of the present invention can be achieved by integrally combined valve plate 3 and cam member 3′ as shown in other embodiments.

Attention should be directed to the fact that the effective opening area of bore ends 41 is increased by forming them into an elliptic configuration or the like for facilitating smooth flow of the fluid upon flowing into and out of bores 40.

Since the fluid in bores 40 acts to strongly urge valve plate 3 against the side wall of the valve housing causing frictional drag therebetween, pressure compensating chambers 42 are provided in the side wall of valve housing 1 for relieving the frictional drag against the rotation of valve plate 3. Pressure compensating chambers 42 are to provide force acting on valve plate 3 opposing the force caused by the fluid in bores 40. Each chamber 42 is aligned with the corresponding bore 40. In fluid chambers 4*a* and 4*b*, coil springs 15 extending in the direction of eccentricity are provided for establishing stability of cam member 3′ and valve plate 3 in the central position thereof. Each coil spring 15 acts on the inner peripheral surface at one end thereof with the other end bearing on principal shaft 2.

Secondly, it is expected that excessive relative angular displacement between input shaft 8 and valve shaft 2 occurs when the input shaft is abruptly rotated for some reason. However, in the present invention, such problem is resolved by opening 34 in valve shaft 2 and stop pin 35 secured to input shaft 8 so as to extend into opening 34. The stop pin also functions to prevent input shaft 8 from being detached.

The principle of this invention is believed to be fully understood from the previous description referring to the first embodiment.

Other embodiments of the invention or modifications of the first embodiment will be described. The same references are used to indicate the members and portions which effect the same operations as those of the corresponding members and portions in the first embodiment. Since the present invention is not intended to improve the hydraulic motor, only the control means for the fluid guide valve and the signal input means will be described in the following description. The structure of the other portions of the following embodiments can be understood by referring to the structure of the first embodiment.

Figure 7:
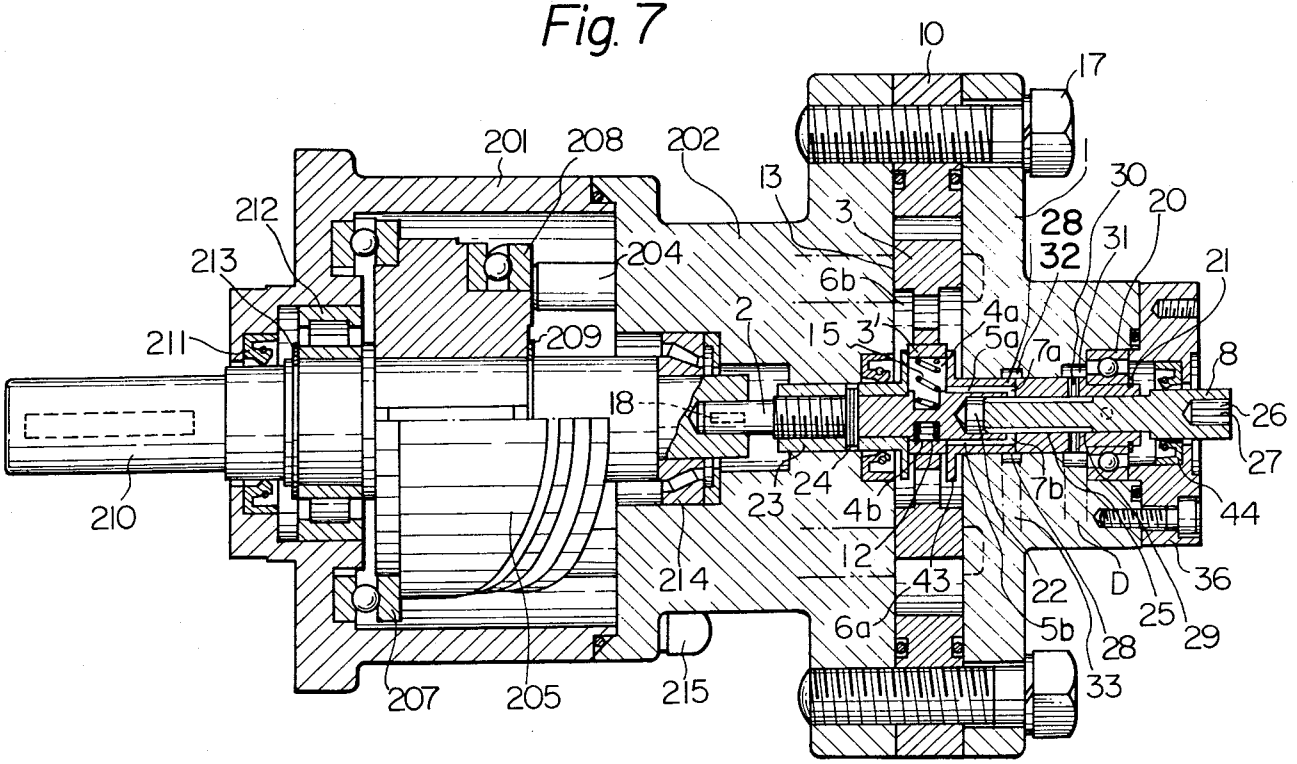
FIG. 7 is a sectional view taken along the line VII—VII in FIG. 6.
Figure 8:
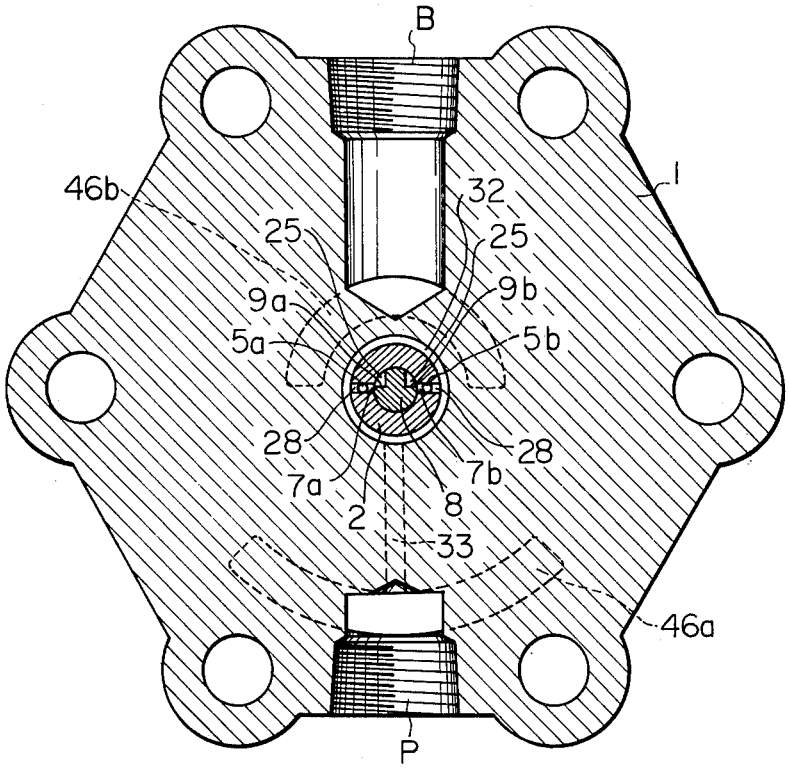
FIG. 8 is a sectional view taken along the line VIII—VIII in FIG. 5.
Figure 14:
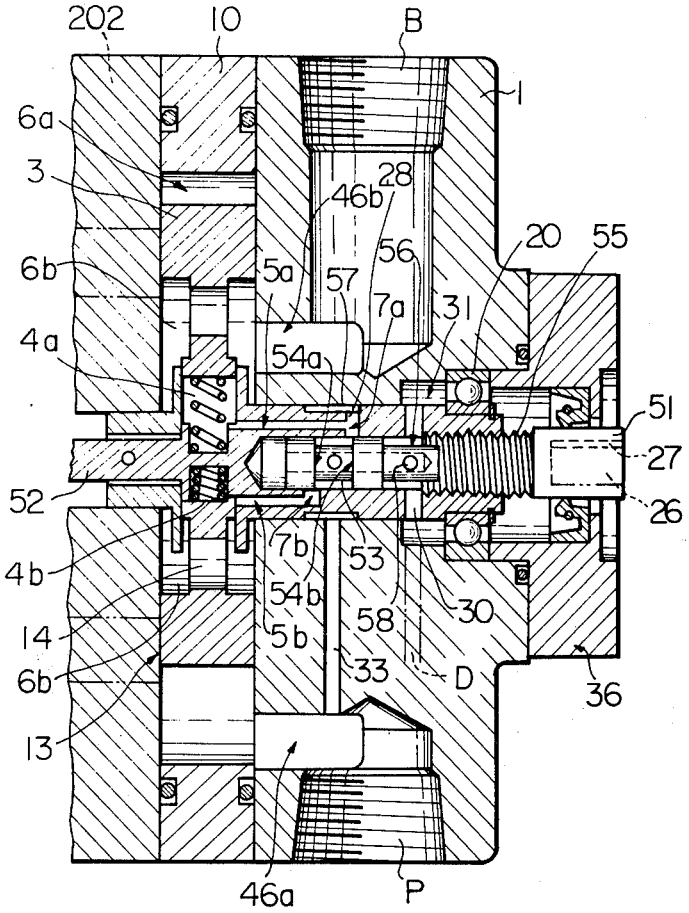
FIG. 14 is a sectional view of another embodiment of the invention.

FIG. 14 shows a structure, the major portion of which is equivalent to the corresponding portion of the embodiment shown in FIGS. 5 and 7. Although a portion of the entire apparatus is illustrated, the structure of the entire apparatus will be made clear by referring to the drawings relating to the first embodiment. In the control means of this embodiment, guide passages 5*a* and 5*b* opening into variable fluid chambers 4*a* and 4*b* are connected to intermediate portions of passages 7*a* and 7*b* which are provided in axially offset positions so as to extend in opposite directions. Each passage 7*a* and 7*b* extends from the outer periphery of valve shaft 52 to the axial center bore formed in shaft 52 and is provided with a fixed throttle at a position adjacent its outer end. The axial bore in principal valve shaft 52 has a screw thread 55 at the outer end portion thereof. In the forward portion of signal input shaft 51 received in valve shaft 52 is an annular groove 53 of a predetermined width having on the opposite sides two closure surfaces 54*a* and 54*b.* The closure surfaces adjustively close the inner ends of passages 7*a* and 7*b* to restrict the opening areas of the passages. The closure surfaces vary the degree of restriction of the passages in an opposite manner to each other according to the relative movement in the axial direction between valve shaft 52 and input shaft 51. A male screw thread portion mating with thread portion 55 in the axial bore of valve shaft 52 is formed on input shaft 51 to establish a threaded engagement between signal input shaft 51 and valve shaft 52. In input shaft 51, conduit 58 is formed, which runs therein along the centerline thereof to connect annular groove 53 for forming closure surfaces 54 to the annular space encircling reduced diameter portion 56 at the intermediate portion of the signal shaft. Passages 30 connect the annular space around the input shaft to the annular space encircling valve shaft 52 formed for drainage of the fluid. Annular groove 57 is formed on the outer periphery of valve shaft 52 and has a width such that passages 7*a* and 7*b* open into groove 57. Thus, groove 57 forms a chamber for supplying pressurized fluid to passages 7. Input shaft 51 has an axial bore 26 for connecting thereto a primary input shaft directly coupled to single supply means. Bore 26 has a key way 27 for receiving a key for preventing relative rotation of the primary input shaft and shaft 51. As shown in the drawing, the axial movement of the principal valve shaft is also arrested by ball bearing 20 in this embodiment.

In summary, the feature of this embodiment is that signal input shaft 51 is adapted to axially move relative to principal valve shaft 52 according to the rotation of input shaft 51 through the screw thread engagement between the input shaft and the valve shaft, and the degree of opening of passages 7*a* and 7*b* is adapted to be changed by the axial movement of the input shaft.

It should be understood that the operation of this embodiment is the same as that of the first embodiment, except for the manner of cooperation between the valve shaft and the signal input shaft.

The purpose of annular groove 53 is to provide closure surfaces 54*a* and 54*b* facing each other. It should be appreciated that such means for forming the closure surfaces is not limited to the structure of this embodiment and any suitable means such as the one shown in FIG. 16 (which will be explained hereafter) is available for the same purpose. Although valve plate 3 of this embodiment has a cam portion integrally formed therewith, which corresponds to the cam member 3' of the first embodiment, it should be appreciated that such modification is not outside the scope of the present invention.

Figure 15:
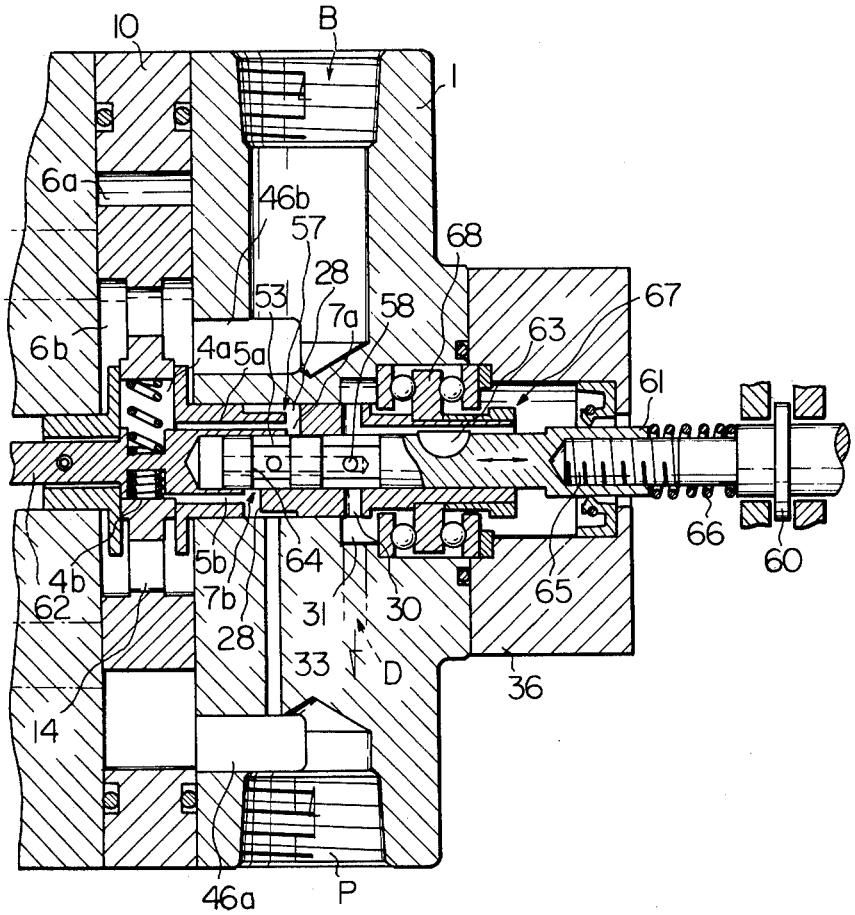
FIG. 15 is a sectional view of still another embodiment of the invention.

A further modified form of the present invention illustrated in FIG. 15 will be apparent from the following description. The structure is based on that shown in FIG. 14, but differs therefrom with respect to the signal input means. More specifically, a stop key 63 is held between a principal valve shaft 62 and a signal input shaft 61 at the point they fit together to prevent them from changing their relative angular positions, but permit their relative movement in the axial direction. A flange 68 is formed on the principal valve shaft 62 and is supported in a prescribed position in the valve housing 1 to position the principal valve shaft 62 in the axial direction. The signal input shaft 61 is internally threaded at 65 at the input end to threadedly receive a first input shaft 60 therein which is directly connected to signal input supply means positioned in the axial direction thereform. A coil spring 66 surrounds the signal input shaft 61 between the end face thereof and the other end face formed on a different diameter portion of the first input shaft 60 to compensate for any clearance in the threaded portion 65 to prevent backlash. It is noted that the flange 68 is rigidly secured on the principal valve shaft 62 by threaded bushing 67 and is an intermediate rotor of a composite thrust ball bearing separate from the principal valve shaft 62. The rotor has on opposite sides thereof balls and rotors for the thrust ball bearing. The two additional rotors are held against the valve housing 1 and the closure member 36 to position the shaft 62 in the axial direction.

In brief, the structure as above-described is characterized by signal input means which is adapted to prevent a relative rotational movement between the valve principal shaft 62 and the signal input shaft 61, but to allow a relative movement thereof in the axial direction, and to that end the first input shaft 60 and the signal input shaft 61 are threaded at 65 to screw them together to produce a screw movement therebetween, thereby converting rotation of the first input shaft 60 to an axial movement of the signal input shaft 61, displacement of the input shaft 61 with respect to the principal shaft causing the sectional area of the ports 7*a* and 7*b* taken along the housing bore and in communication with the variable fluid chambers 4*a* and 4*b* to vary in the opposite sense to each other. It is noted that this structure is similar to that shown in FIG. 14 in that the signal input shaft 61 is arranged to carry out its displacement with respect to the principal valve shaft 62 to control the opening of the ports 7*a* and 7*b* without a relative rotational movement between the principal shaft 62 and the input shaft 61.

In this construction, closure means 64 may be provided by cutting away the peripheral surface of the input shaft to form a stepped portion as closure means instead of providing an annulus, thereby attaining the same function as in closure means in the annular form.

Figure 16:
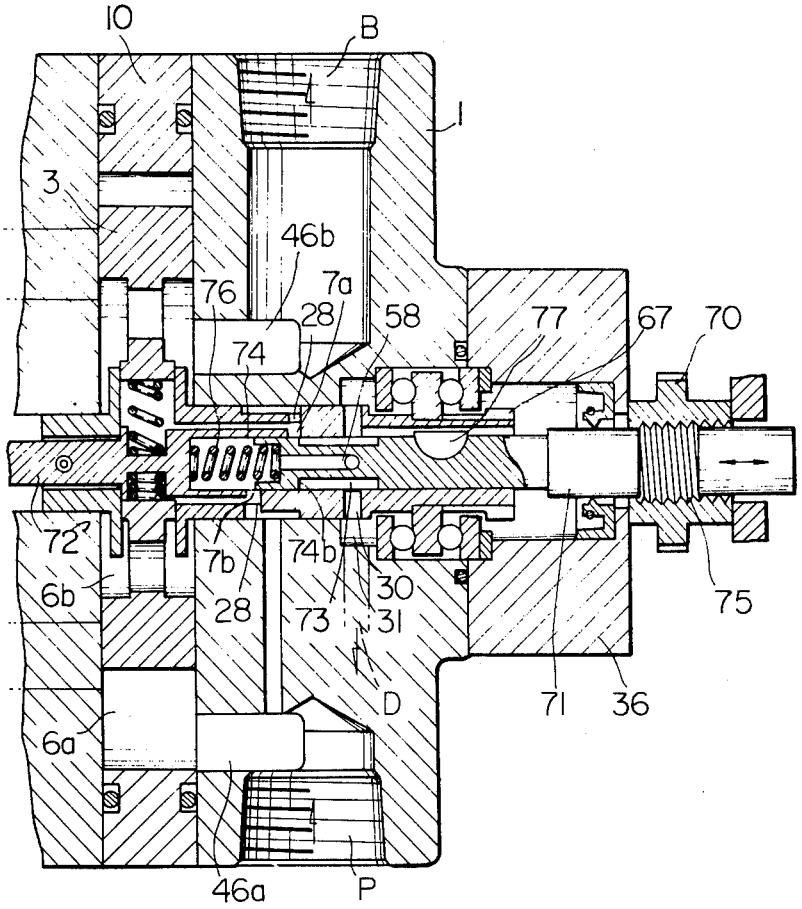
FIG. 16 is a sectional view of a modified structure of the embodiment of FIG. 15.

In FIG. 16, another modified form of the present invention is shown which has a structure which acts as a control means by which displacement of the signal input shaft with respect to the principal valve shaft varies the opening of the slots by means of a different signal input means.

The pair or ports 7*a* and 7*b* are at different positions in relation to each other in the direction of the length of the principal valve shaft 72 and pass therethrough toward the axial bore in the valve shaft and fixed slots 28 are provided on the ports at the positions near the outer periphery of the shaft. A signal input shaft 71 received in the axial bore includes a head portion and a reduced diameter portion 73 formed at a suitable portion thereof. An end face 74 of the head portion and a side face of the reduced diameter portion 73 opposite the end face 74 function as closure means 74*b* to open and close the ports open to the axial bore. A conduit pore passes from the end face 74 of the input signal shaft 71 through the shank thereof and communicates with the reduced diameter portion 73 at the periphery thereof. This passage is completed by apertures 30 in the principal shaft 72 radially extending from the reduced diameter portion, a space 31 extending circumferentially of the principal shaft, and a drain port D extending therefrom. The signal input shaft 71 is provided with a stop key 77 serving as an anti-rotation means to prevent the valve principal shaft 72 from changing in its angular position but permitting an axial displacement of the two shafts relative to each other.

It is noted that the structure as above-described is very similar to the structure shown in FIG. 14, and that a thread 75 is provided on the signal input shaft 71 at the input end and a gear 70 is threaded thereon, the gear being positioned coaxially with shaft 71. Another gear connected to signal input supply means such as an electric pulse motor or the like is provided to impart rotation to the gear 70. A coil spring 76 is provided within shaft 72 urging shaft 71 into engagement with the gear 70 for compensating for backlash as in the embodiment in FIG. 15. Of course, a shaft type member with a threaded hole as shown in FIG. 15 may be substituted for the gear.

It is noted that the operation of the structure shown in FIG. 16 is similar to that of the apparatus shown in FIGS. 14 and 15, except for the application of a signal input rotation to the gear 70 to axially displace the signal input shaft 71 with respect to the principal valve shaft 72 to control the open area of the ports 7*a* and 7*b* therein.

A further modified form of control means is illustrated in FIGS. 17 and 18. In this structure, the principal valve shaft 82 is provided with a bore having a larger diameter and which is internally threaded. Conduit ports 5*a* and 5*b* in communication with the respective variable fluid chambers 4*a* and 4*b* are open into the larger diameter bore portion in the principal shaft. The ports 7*a* and 7*b* are bored through the principal valve shaft 82 at the midportions of the conduit ports 5*a* and 5*b* and in the ports 7*a* and 7*b* the fixed throttles are formed. A signal input shaft 81 is held at its fore end in the bore in the principal valve shaft 82 and closure means is provided on shaft 81 in the form of a flange 83. As is shown in FIG. 18, closure means is formed by a portion of the periphery of the flange 83 of the signal input shaft 81 having apertures 84*a* and 84*b* therein. The signal input shaft 81, which is provided with the flange 83 with such closure means, is fitted at its fore end in a small diameter bore portion in the principal valve shaft 82 with the flange 83 in contact with the bore end face from which ports 5*a* and 5*b* open. Screw 85 is held in the principal shaft to prevent the input shaft from being displaced with respect to the principal shaft. The screw 85 is preferably provided with locking means. In FIG. 18, numeral 86 designates a lock pin which is mounted on the principal shaft 82 at the end face of the larger diameter bore portion to prevent an excessive angular displacement of input shaft 81 relative to the principal shaft 82. A notch in the input shaft flange 83 has an engaging surface 87 to engage the lock pin 86 at a suitable angular position of input shaft 81. The signal input shaft 81 has at its one end a connecting bore 88 for connection of the first input shaft to signal input means. The structure of this type is adapted to effect a control action by rotation of the input signal shaft 81. A key groove 89 is formed in the connecting bore 88 to prevent rotation of the signal input means relative to the first input shaft. It is understood that although the closure means has an arcuate form instead of a plane form, other configurations will be apparent to those skilled in the art.

The operation of this embodiment will be explained hereinafter.

In operation, the apertures 84*a* and 84*b* in the periphery of input shaft flange 83 function as closure means to control the discharge areas of the ports 5*a* and 5*b,* and in the normal position of flange 83, the areas are equal. Pressure in the variable fluid chambers 4*a* and 4*b* is thus maintained equal to hold the valve plate 3 centrally with respect to the valve shaft 82 to obstruct the fluid guide action when the signal input shaft 81 is stationary.

When a signal input rotation in the clockwise direction of the arrow in FIG. 18 is imparted to the signal input shaft 81, the conduit port 5*a,* as shown, is closed to a size which is less than the normal size with the flange 83 in the normal position. The other conduit port 5*b* is in turn opened to a size larger than the port 5*a.* In this manner, differential pressure is supplied to the variable fluid chambers 4*a* and 4*b.* Control means thus serve to move the valve plate 3 to the eccentric position (FIG. 17) to apply a fluid guide action to the hydraulic motor in a manner as in FIGS. 7, 11 and 12. The operation of the valve guide means and the like other than that as above-described will be understood from the description of the first embodiment, and it will not be necessary to describe it in detail herein. Suffice it to say that the structure shown in FIG. 18 is arranged so that the displacement angle of the two shafts 81 and 82 relative to each other is limited to a predetermined amount by the engagement of the lock pin 86 in the notch in the flange 83 with the engaging surface 87 defining the notch.

Figure 19:
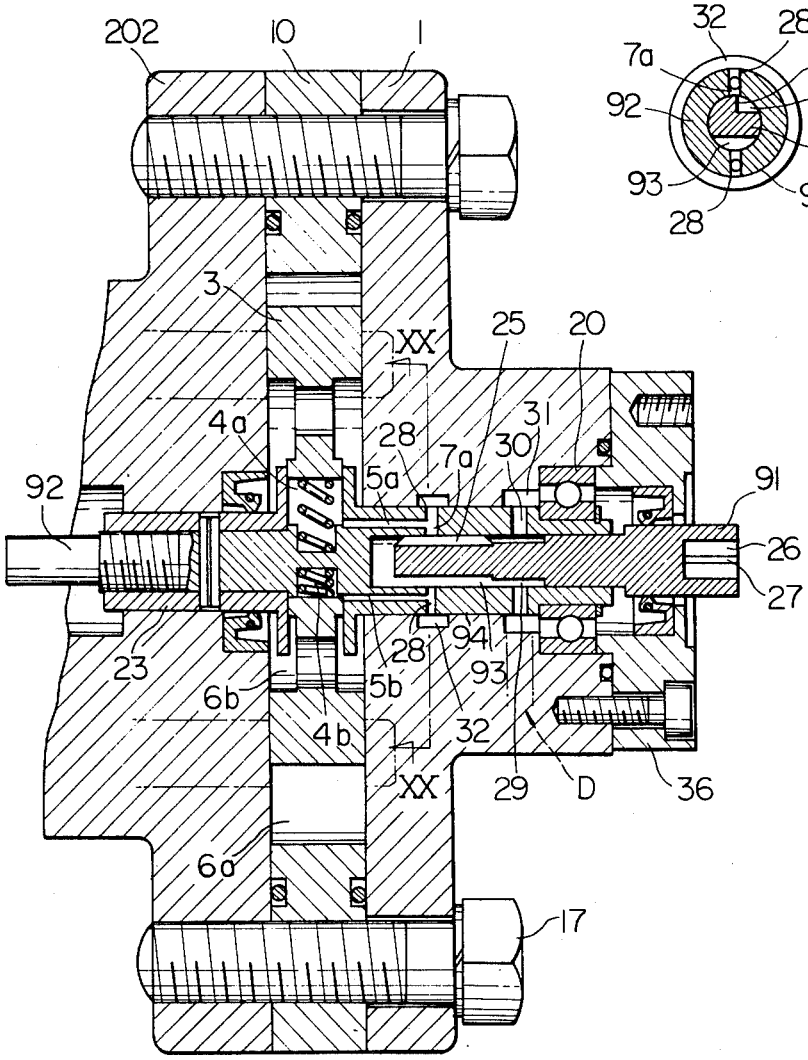
FIG. 19 is a sectional view of yet another embodiment showing a portion corresponding to a part of FIG. 7.
Figure 20:
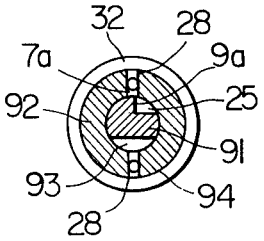
FIG. 20 is an illustration of the primary portion of the sectional view taken along line XX—XX in FIG. 19.

Another modified form of the structure will be described with reference to FIGS. 19–20, wherein the structure is shown as control means for the rotary type fluid guide valve of the present invention constructed on the principle of the hydraulic servo valve shown in FIG. 3. This structure is fabricated in the same manner as in FIG. 7, and the principal valve shaft 92 is provided with one port 7*b,* the port having a fixed size opening into the bore within shaft 12 and being connected with a fixed size aperture 28 at the inlet end to keep the fluid pressure in the variable fluid chamber 4*b* constant. As shown in FIG. 20, the signal input shaft is inwardly recessed to form a space 93 adjacent the port 7*b* so that the opening of port 7*b* does not change size upon rotation of input shaft 91. With respect to the other port 7*a,* closure means 9*a* formed by the edge of the slot 25 in the signal input shaft 91 acts to vary the opening of the port 7*a* upon relative movement of the principal shaft and the input shaft.

According to the aforementioned structure, a constant predetermined fluid pressure acts on the variable fluid chamber 4*b,* whereas the fluid pressure in the other variable fluid chamber 4*a* will be varied by cooperation of the principal valve shaft 92 and the signal input shaft 91 to supply a differential pressure to the fluid chambers 4*a* and 4*b,* thereby moving the valve plate 3 to the bias position. Such structure for varying pressure in one variable fluid chamber may be used in the structure shown in FIGS. 17, 16 and 15.

Figure 21:
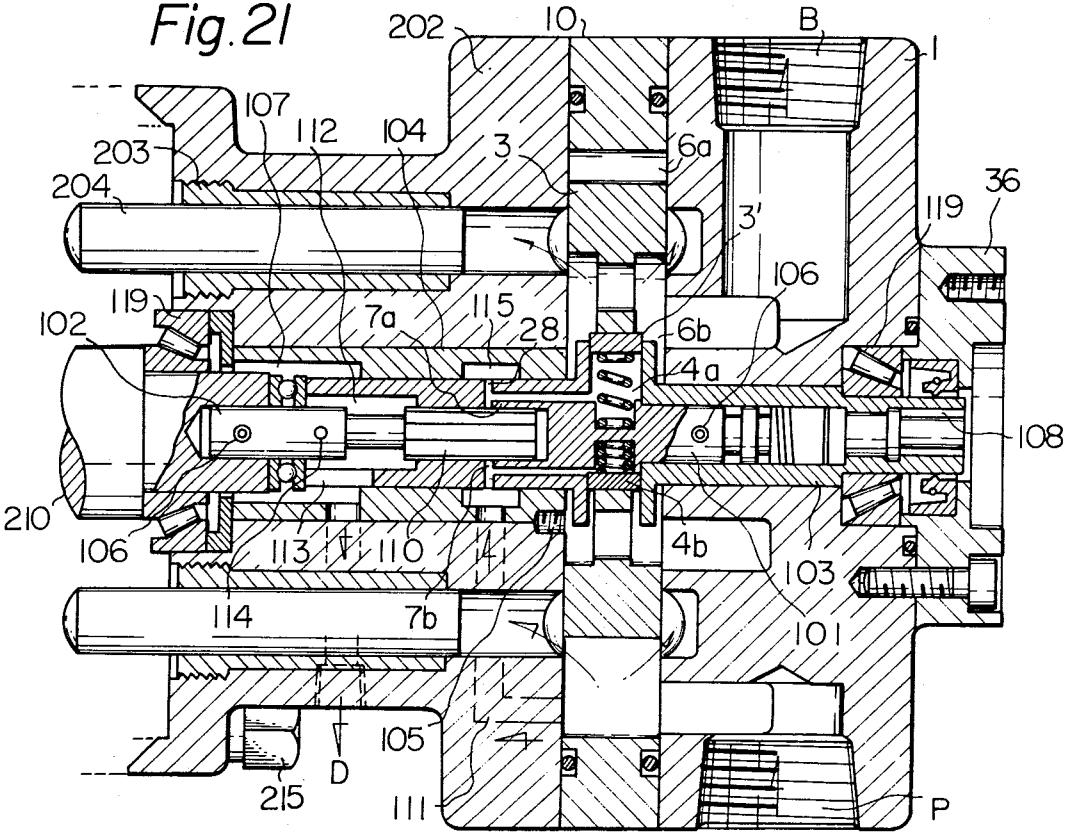
FIG. 21 is a sectional view of a modified form of the first embodiment shown in FIGS. 4–13.

The structure shown in FIG. 21 is based on a substitution of one shaft for another shaft. In other words, this structure is designed so that what corresponds to the principal valve shaft shown in FIG. 7 serves as the signal input shaft, whereas what corresponds to the signal input shaft is employed as the principal valve shaft rotatable with the hydraulic motor to feed back rotation thereof to the valve.

In FIG. 21, numeral 104 designates a sleeve which includes a shank bored to receive therein a signal input shaft 101 at one end thereof and which sleeve is held in position by a machine screw 105. A principal shaft 210 for the hydraulic motor has the journal end thereof bored to receive a principal valve shaft 102. The principal valve shaft 102 is fixed in the principal shaft for feeding back rotation of the hydraulic motor to the valve and is held in position by a spring pin 106. The principal valve shaft 102 is provided with an annular groove 112 centrally thereof and at its one end has two guide grooves 110 extending in the axial direction as in the signal input shaft shown in FIG. 7. One of the guide grooves 110 is adapted to function as closure means 9 for variable reduction of parts *7a* or *7b* as in the same manner as in FIG. 8. The shaft denoted at 101 functions as the signal input shaft, but is adapted to correspond to the principal valve shaft in FIG. 1. The shaft 101 is positioned in the valve chamber 6 and carries the valve plate 3. As previously mentioned, guide means for the valve plate 3 is provided in the valve chamber *6a,6b.*

In the modified form of the structure shown in FIG. 21, a block element 103 is disposed in the variable fluid chamber 4 at one side thereof and is threaded onto the signal input shaft 101. The block element 103 is held in position by another spring pin 106 and extends toward the input side for acting as a coupling for connection with a first input shaft. The block element 103 is provided at its input side with a reduced diameter portion, one end of which includes a taper roller bearing 119 for preventing an axial movement of the block element. Oppositely mounted with respect to the roller bearings are thrust bearings 107 between the signal input shaft 101 and the hydraulic motor to prevent the signal input shaft and block element assembly from moving in the axial and opposite directions. Numeral 108 designates a key groove in a recess in the input end of the block element 103. The key groove 108 serves as stop means by which rotational movement between the first input shaft and the block element is prevented. The sleeve 104 is provided for supporting the signal input shaft 101 and includes an annular groove 115 opening inwardly into the bore thereof facing the ports *7a* and *7b* bored through the input shaft 101. The annular groove 115 serves as a fore chamber for receiving a pressure fluid therein. A passage 111 is formed in the side wall of the outer valve chamber *6a* in communication with the pressure fluid supply port P to supply the pressure fluid to the annular groove 115.

The fluid pressure supplied from the supply port P passes from the annular groove 115 through the fixed size ports 28 in line with the ports *7a* and *7b* to the variable fluid chambers *4a* and *4b.* The pressure fluid then spouts from the ports into the guide groove 110 to control fluid pressure in the variable fluid chambers. The fluid which has spouted into the guide groove 110 passes from the annular groove 112 formed at the center of the principal shaft 102 through a notch 113 in the input shaft 101 to the drain port D and is discharged from the structure.

It is apparent from the foregoing that the modified form of the structure in the embodiment of FIG. 21 is arranged so that the signal input and principal shafts of the first embodiment are replaced by the principal valve and the signal input shafts to effect movement of the valve plate to the eccentric position in a manner which is the reverse of that in the first embodiment, but which achieves the same result. The outstanding feature of the embodiment of FIG. 21 which is different from the first embodiment is that the valve plate is held on the signal input shaft and driven by an input rotation supplied thereto. Since what corresponds to the principal valve shaft of the first embodiment is used herein as the signal input shaft, a considerably higher torque is required to establish a signal input rotation for actuation of the signal input shaft as compared with the first embodiment. However, the embodiment of FIG. 21 achieves the object, since a remarkably amplified torque output rotation is obtained by the input rotation. The present invention is for a connection with an electric pulse motor and provides a synchronous actuator in another hydraulic servo system or other feedback mechanism. For this reason, this is also an effective arrangement even though its use is limited to a certain range.

A further embodiment of the present invention will be apparent from the following description of FIGS. 22–25 compared to the embodiment shown in FIG. 7. This structure is characterized in that the size of the opening of ports *7a* and *7b* which define inlet and exhaust ports for fluid are variable in response to a signal input rotation.

This structure is somewhat similar to the structure shown in FIG. 7, except for the slots. An input rotor 131 is provided and has therein a principal valve shaft 122. The input rotor 131 is bored to receive the principal shaft 122 therein and is cut away at a position corresponding to the location of the ports *7a* and *7b,* the edges 139 of the cut away portions thereby forming closure means for ports *7a* and *7b.* The rotor 131 is further provided at its input end with a hollow recess 128 for connection with a first input shaft and a key groove 127 to prevent relative rotation of the first input shaft and the rotor 131. A valve housing 135 in which the input rotor 131 is fitted has in its inner periphery an annular groove 123 at a position adjacent the cutaway portion of the rotor to define a fore chamber for a fluid supply to closure means 139. A passage 33 extends from groove 123 to a connecting groove *46a* in communication with the fluid supply port P and the valve chamber 6 to normally supply the pressure fluid to the annular groove 123. The valve housing 135 has on its inner periphery another annular groove 126. The input rotor 131 is provided with a central hollow 124 and channels 125 through the rotor 131 in communication with the annular groove 126 in the valve housing 135. A passage is completed by the annular groove 126 and the drain port D. The input rotor 131 has at its input end a reduced diameter portion on which inner race for the ball bearings 20 is mounted. The inner race is nested at its one end against the larger diameter portion of the rotor 131 and is retained by the stop ring 21 at the other end. The outer race for the ball bearings is held between the valve housing 135 and a block element 136 to prevent the input rotor 131 from moving in the axial direction. The input rotor is centrally bored to receive therein the signal input shaft 121 and the latter is held in position by means of a stop key 129, thereby causing the signal input shaft 121 and input rotor 131 to rotate together. The principal valve shaft 122 is arranged in the same manner as in the first embodiment with the input rotor 131 mounted thereon to receive the signal input shaft 121 therein. The principal shaft 122 is connected at the other end to the motor section, as will be described, and rotated with the motor. The signal input shaft 121 is provided with the two guide grooves 25 extending in the axial direction. The one sides of the guide grooves 25 face in the opposite rotational direction from corresponding edges 139 and are used as closure means 9*a* and 9*b* for the ports 7*a* and 7*b* in the valve principal shaft 122. The guide grooves 25 extend to the center of the signal input shaft 121 from which extends a drain passage formed of the central hollow 124 which is formed in the input rotor 131 and has a diameter larger than the input shaft, the channels 125, the annular groove 126, and the drain port D. The ports 7*a* and 7*b* are connected by the conduit ports 5*a* and 5*b* to the variable fluid chambers 4*a* and 4*b* which serve as guide means for the valve plate 3 in the same manner as in the previous embodiment. In FIG. 24, numeral 133 designates a lock pin which is provided to prevent excessive relative rotation between the input rotor and the principal shaft 122. The location and orientation of each of the closure means formed in the input rotor and signal input shaft also constitutes an important factor of this embodiment, as will be apparent from the following description.

The arrangement and operation of guide means in this embodiment are the same as in the first embodiment, and the signal input means is similar to that in the first embodiment in use of rotational input. Thus, it will not be necessary to describe them in detail herein. It will suffice to describe the control means of this embodiment.

Referring to FIGS. 23 and 24, particularly FIG. 24, a signal input rotation is applied to rotor 131 by signal supply means. Closure means 9*a* and 9*b* on the signal input shaft 121 and closure means 139 on the input rotor 131 are engaged with the inner and outer ends of ports 7*a* and 7*b* provided in the principal valve shaft 122 to control the area of the openings into and out of each of the ports. The signal input shaft 121 shown in FIG. 24 is rotated with the input rotor 131 in the counterclockwise direction as indicated by the arrow. As clearly shown in FIG. 24, since side 9*a* faces in the opposite rotational direction from corresponding edge 139, the port 7*a* has the area of the end open to the input shaft 121 reduced, whereas the area of the other end open to the rotor 131 is increased to thus facilitate the supply of fluid from the circumference of the principal shaft 122 to further provide a limitation on the flow rate. As a result, the fluid pressure in the variable fluid chamber 4*a* in communication with the port 7*a* is increased. The other port 7*b* has the size of the opening of the end open to the input shaft 121 made larger, while the opening of the other end open to the rotor 131 is reduced, thereby decreasing the fluid pressure in the variable fluid chamber 4*b* in communication with the port 7*b.* By the differential pressure between the variable fluid chambers 4*a* and 4*b* as described above, the valve plate 3 is moved toward the highly pressurized variable fluid chamber 4*a* and is off center in the housing 135 to apply a fluid guide action to the hydraulic motor, as explained in connection with the first embodiment, thereby allowing the hydraulic motor to rotate in a predetermined direction. In this instance, input signal rotation in a direction opposite to that described above moves the valve plate 3 in the direction opposite to that shown in FIG. 23 to produce an output rotation in the direction opposite to what has been described. Termination of the rotation of the signal input shaft and the rotor causes return of the size of the openings of the ports 7*a* and 7*b* to normal to bring the fluid pressure in the variable fluid chambers 4*a* and 4*b* to an equilibrium state to return the valve plate to the central position, thereby terminating the fluid guide action.

Figure 22:
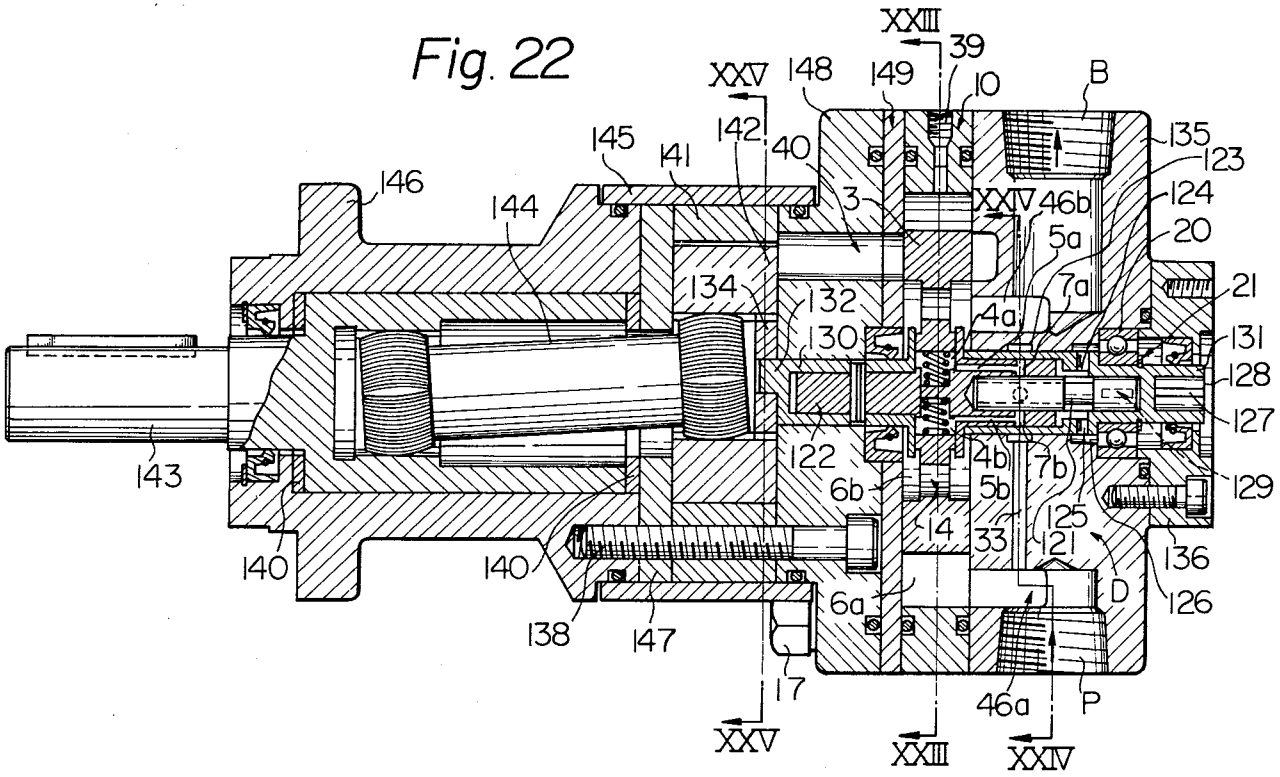
FIG. 22 is a sectional view of another embodiment of the invention.

It is noted that a modified form of the structure shown in FIG. 22 uses a conventional trochoid reduction hydraulic motor instead of what has been described in the previous embodiments. The motor structure comprises a base structure 146, a dashboard 147 mounted thereon at one end thereof, an outside gear 141 mounted adjacent the dashboard at one side thereof, a bracket 148 disposed rearwardly of the base structure, and a sleeve 145 secured to embrace the aforementioned parts, whereby they are held in place. A principal motor shaft 143 is mounted inwardly of the base structure 146. The outside gear 141 is adapted to receive therein an inside gear 142 having a number of teeth fewer by one than the outside gear to engage with each other. An oscillating spline shaft 144 is provided to connect the inside gear 142 with the principal motor shaft. A spacer 149 is disposed between a bracket 148 and a valve arrangement to act as a side wall of the valve chamber 6 and is provided with apertures which function as valve openings with respect to the motor.

In the trochoid gearing combination of the two gears, one with less number of teeth by one than the other gear, the outside gear 141 is fixedly mounted to receive therein the inside gear 142 eccentrically meshing with the outside gear. With this arrangement, the fluid pressure acts on the teeth of the outside and inside gears to cause the inside gear 142 to establish a rolling movement along a circular orbit in relation to the outside gear. As the inside gear 142 is connected by the spline shaft 144 to the principal motor shaft 143, the rotational force of the inside gear 142 is transferred to the principal motor shaft 143. This structure is characterized in that one rotation of the inside gear provides a hydraulic pressure cycle corresponding to what is multiplied by the number of teeth of the inside gear. The principal valve shaft for the guide valve of the invention is fixedly mounted on the principal motor shaft for relying on the plunger type motor so that the feedback rotation with respect to the guide valve is required to be proportional to a rotation cycle of the hydraulic motor. In the trochoid motor according to this embodiment, the principal motor shaft is rotated at a rate of one number of teeth of the inside gear, namely of one part of a hydraulic cycle. The trochoid motor is thus required to include means, as will be described, to impart a hydraulic cycle to the principal shaft.

A sleeve 134 is positioned inwardly of the splined center hole in the inside gear to receive a projection 132 formed eccentrically on a block element 130 at the connection of the principal valve shaft 122 and the motor. As noted from the foregoing, the inside gear 142 is rotated along a circular orbit (*n*) around the center of the outside gear 141 to produce rotation at a rate multiplied by the number of teeth of the inside gear, namely, corresponding to the hydraulic cycle. With this arrangement, the orbital rotation is transferred to the principal valve shaft 122 to feed back rotation corresponding to the hydraulic cycle.

It is noted that the modified form of the invention in combination with the plunger motor is described as producing a bodily rotation of the motor shaft with the valve shaft. However, it is intended to include all means for feeding back the hydraulic cycle of the hydraulic motor.

For a better understanding of the invention, one more embodiment will be described hereinafter.

Figure 26:
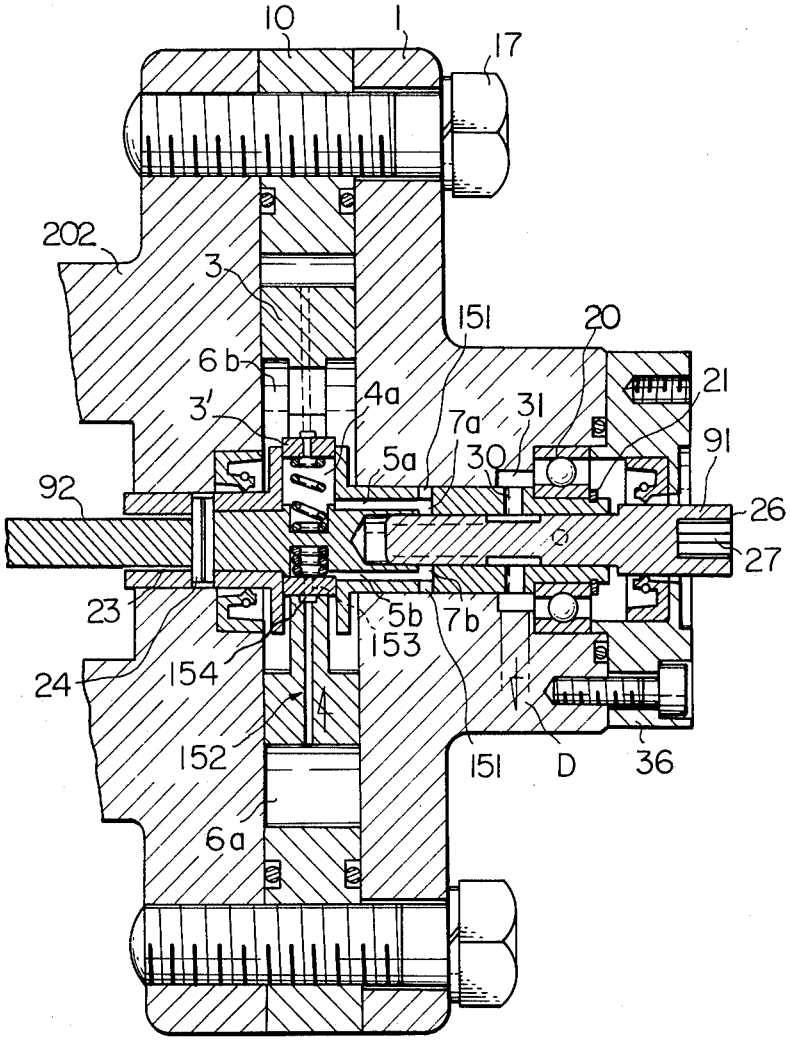
FIG. 26 is a sectional view of still another embodiment of the invention.

Referring to FIG. 26, the structure shown therein is not provided with the annular groove 32 as in FIG. 7, and the slots 28 in the fluid supply path are each closed by a plug 151. The valve plate 3 includes a conduit port 152 passing therethrough and to a cam member 3' within the center of plate 3. The cam member 3' has ports 153 in communication with the variable fluid chambers from slot 154 into which port 152 opens. Although this is a modified form of the fluid supply means shown in FIG. 7, this is within the spirit of the invention. One of the reasons why the conduit port 152 is led from the valve plate 3 adjacent the valve outer chamber 6a is that the pressure fluid acts on the valve plate.

Referring to FIGS. 14, 15 and 16, in each structure the input shaft is axially moved relative to the principal shaft for providing a control action, and they are threaded to effect a helical movement. In this instance, it is customary to apply a spring force in one direction for allowing one thread surface to act on the other. Notwithstanding, the structure shown herein does not always require a resilient or elastic member such as a spring. This is because the signal input shaft head has a smaller diameter than that of the shaft end on which a seal member is mounted so that fluid discharged out of the slot, even at a low pressure, acts on the input shaft to move it in the axial direction for a backlash compensation effect. In brief, the present invention is characterized by valve guide means for allowing the circular valve plate to close or open the disposed valve openings, control means for displacing the valve plate to a predetermined position, and signal input means for the control means. The thus constructed structure or modified form thereof may be used with the aforementioned feedback hydraulic motor means. By the use of the feedback hydraulic motor means in the first embodiment, the signal input shaft is subjected to a lesser resistance to input rotation so that a slight input rotational torque from a so-called electric pulse motor may be applied. Further, a good response is obtained, even when responding to a small input rotational angle and a high output, and an optional output rotational number is obtained by a weak torque signal input, such as a weak pulse motor or the like.

Although the invention has been described in detail with particular reference to the preferred embodiments thereof, it will be understood that variations and modifications can be effected within the spirit and scope of the invention.

What is claimed is:

1. In an electric-hydraulic pulse motor consisting of a hydraulic motor having a housing, a rotor and a plurality of bores formed in said housing and disposed circularly around the axis of rotation of said rotor for being supplied in order with pressurized fluid to actuate said rotor; and rotary guide valve means adapted to be connected to signal input means such as an electric pulse motor for sequentially supplying the pressurized fluid to said bores, the rotary guide valve means comprising:

means defining a valve chamber with which said bores in the hydraulic motor communicate;

a valve shaft and a signal input shaft movably supported in said valve chamber defining means in engagement with each other for relative movement relative to each other, at least one of said shafts being rotatable in said means and having a portion thereof extending through said valve chamber;

a valve member in said valve chamber having an annular portion dividing said valve chamber into an outer valve chamber portion and an inner valve chamber portion, said annular portion having an annular closure surface which closes the ends of all the bores of said hydraulic motor when the valve member is in a central position between said inner and outer valve chamber portions, said valve member being provided with an elongated opening at the center thereof through which said portion of the shaft in the valve chamber extends so as to divide said opening into two sections;

means yieldably biasing said valve member to its central position;

means operatively associated with said valve member and said portion of the shaft in the valve chamber for preventing relative rotation between said valve member and said one of said shafts while allowing the valve member to move transversely relative to said one of the shafts to either of two eccentric positions in which the bores on one side of the annular portion communicate with the outer valve chamber portion and the bores on the opposite side of the annular portion communicate with the inner valve chamber;

means engaging with said valve member for closing both sides of each of said sections of said opening thereby forming two variable size fluid chambers on the opposite sides of said shaft portion in the valve chamber;

passage means for supplying pressurized fluid to each variable size fluid chamber and discharging the fluid therefrom, said passage members each having throttle means at a portion thereof where said valve shaft and said input shaft engage with each other, said throttle means being for varying the fluid pressure in at least one of said variable size fluid chambers according to the relative movement between the two shafts;

conduit means for connecting a source of pressurized fluid to one of said valve chamber portions and connecting the other portion to a discharge port; and means for interconnecting said rotor of the hydraulic motor to said valve shaft for causing the valve shaft to rotate in the same direction as the rotational direction in which the pressurized fluid should be sequentially supplied to said bores in the hydraulic motor.

2. An electric-hydraulic pulse motor according to claim 1 in which said valve member has an inner cam portion and outer valve plate portion carried on the cam portion for relative sliding movement thereon for reducing the drag with respect to the rotation of the shaft portion extending through said elongated opening.

3. An electric-hydraulic pulse motor according to claim 1 in which a recess is provided in the motor around the ends of the bores of said hydralic motor which open into said valve chamber, said recess extending circumferentially of said valve chamber.

4. An electric-hydraulic pulse motor according to claim 1 in which said means defining said valve chamber has pressure compensating recesses therein, each of which is located at a position opposite to the end of a bore and on the other side of said valve member from said bore.

5. An electric-hydraulic pulse motor according to claim 1 in which said means for preventing relative rotation between said valve member and the shaft portion extending through said elongated opening of the valve member comprises two parallel surfaces on the periphery of said elongated opening of the valve member and two parallel surfaces on the shaft portion slidably engaging each other.

6. An electric-hydraulic pulse motor according to claim 1 in which said means for preventing relative rotation between said valve member and the shaft portion extending through said elongated opening of the valve member comprises a pin fixed to said valve member and extending in the direction of elongation of said opening in a direction parallel with the longitudinal axis of the elongated opening and said shaft portion having a hole therein slidably receiving said pin.

7. An electric-hydraulic pulse motor according to claim 1 in which said means for closing both sides of each of said opening comprises two flange portions on the shaft portion extending through said elongated opening.

8. An electric-hydraulic pulse motor according to claim 1 in which said means for yieldably biassing said valve member to its central position comprises a coil spring confined in each of said variable size fluid chambers.

9. An electric-hydraulic pulse motor according to claim 1 in which said throttle means comprises means for varying the fluid pressure in said variable size fluid chambers in opposite directions to each other according to the relative movement between the two shafts.

10. In an electric-hydraulic pulse motor consisting of a hydraulic motor having a housing, a rotor and a plurality of bores formed in said housing and disposed circularly around the axis of rotation of said rotor for being supplied in order with pressurized fluid to actuate said rotor; and rotary guide valve means adapted to be connected to signal input means such as an electric pulse motor for sequentially supplying the pressurized fluid to said bores, the rotary guide valve means comprising:

means defining a valve chamber with which said bores in the hydraulic motor communicate;

a valve shaft having a portion extending through said valve chamber and having an axial bore therein;

a housing rotatably supporting said valve shaft;

a valve member in said valve chamber having an annular portion dividing said valve chamber into an outer valve chamber portion and an inner valve chamber portion, said annular portion having an annular closure surface which closes the ends of all the bores of said hydraulic motor when the valve member is in a central position between said inner and outer valve chamber portions, said valve member being provided with an elongated opening at the center thereof through which said portion of the valve shaft in the valve chamber extends so as to divide said opening into two sections;

means yieldably biasing said valve member to its central position;

means operatively associated with said valve member and said portion of said valve shaft in the valve chamber for preventing relative rotation between said valve shaft and said valve member while allowing the valve member to move transversely relative to said valve shaft to either of two eccentric positions in which the bores on one side of the annular portion communicate with the outer valve chamber and the bores on the opposite side of the annular portion communicate with the inner valve chamber;

means engaging with said valve member for closing both sides of each of said sections of said opening thereby forming two variable size fluid chambers on the opposite sides of said valve shaft portion in said valve chamber;

passing means extending to each variable size fluid chamber for supplying pressurized fluid to each variable size fluid chamber and connecting each variable size fluid chamber to said axial bore in the valve shaft thereby defining discharge openings in the wall of said axial bore;

a signal input shaft having a portion movably positioned in said axial bore in the valve shaft for relative movement thereto, said portion of the signal input shaft having closure surface means cooperating with the discharge openings for varying the effective opening area of at least one of said discharge openings according to said relative movement;

means for guiding the fluid spouting from said discharge openings to a drain port;

conduit means for connecting a source of pressurized fluid to said outer valve chamber and connecting said inner valve chamber to a discharge port; and means for interconnecting said rotor of the hydraulic motor to said valve shaft for causing the valve shaft to rotate in the same direction as the direction of rotation in which the pressurized fluid should be sequentially supplied to said bores in the hydraulic motor.

11. An electric-hydraulic pulse motor according to claim 10 in which said valve member has an inner cam portion and outer valve plate portion carried on the cam portion for relative sliding movement thereon for reducing the drag with respect to the rotation of the shaft portion extending through said elongated opening.

12. An electric-hydraulic pulse motor according to claim 10, in which a recess is provided in the motor around the ends of the bores of said hydraulic motor which open into said valve chamber, said recess extending circumferentially of said valve chamber.

13. An electric-hydraulic pulse motor according to claim 10 in which said means defining said valve chamber has pressure compensating recesses therein, each of which is located at a position opposite to the end of a bore and on the other side of said valve member from said bore.

14. An electric-hydraulic pulse motor according to claim 10, in which said means for preventing relative rotation between said valve member and the shaft portion extending through said elongated opening of the valve member comprises two parallel surfaces on the periphery of said elongated opening of the valve member and two parallel surfaces on the shaft portion slidably engaging each other.

15. An electric-hydraulic pulse motor according to claim 10 in which said means for preventing relative rotation between said valve member and the shaft portion extending through said elongated opening of the valve member comprises a pin fixed to said valve member and extending in the direction of elongation of said opening in a direction parallel with the longitudinal axis of the elongated opening and said shaft portion having a hole therein slidably receiving said pin.

16. An electric-hydraulic pulse motor according to claim 10 in which said means for closing both sides of each of said opening comprises two flange portions on the shaft portion extending through said elongated opening.

17. An electric-hydraulic pulse motor according to claim 10 in which said means for yieldably biassing said valve member to its central position comprises a coil spring confined in each of said variable size fluid chambers.

18. An electric-hydraulic pulse motor according to claim 10 in which said signal input shaft is rotatably received in said axial bore in the valve shaft and said discharge openings and said closure surface means of the input shaft are related so that the relative rotation between the valve shaft and the input shaft varies the effective opening areas of said discharge openings in the opposite direction to each other.

19. An electric-hydraulic pulse motor according to claim 10 in which said signal input shaft is received in said axial bore in the valve shaft for relative axial movement thereto and said discharge openings and said closure surface means of the input shaft are related so that the relative axial movement of the valve shaft and the input shaft varies the effective opening areas of said discharge openings in the opposite direction to each other.

20. An electric-hydraulic pulse motor according to claim 10 in which passage means comprises an inlet conduit connecting said outer valve chamber to each of said variable size fluid chambers, and an outlet conduit from each of said variable size fluid chambers to said axial bore in said valve shaft.

21. An electric-hydraulic pulse motor according to claim 10 in which said means for guiding the fluid spouting from said discharge openings to a drain port includes grooves in the peripheral surface of said signal input shaft extending parallel to the axis thereof.

22. An electric-hydraulic pulse motor according to claim 10 in which said passage means comprises axis conduit parallel to the axis of said valve shaft, one connected to each of said variable size fluid chambers and extending to an intermediate portion of the valve shaft and two radial conduits, each of the axial conduits communicating with a corresponding radial conduit at an intermediate portion of the radial conduit, each of the radial conduits having an outer end which opens at the outer periphery of the valve shaft and is connected to the source of pressurized fluid and an inner end which opens at the wall of said axial bore in the valve shaft to form said discharge opening.

23. An electric-hydraulic pulse motor according to claim 22 in which said signal input shaft has another portion encompassing a portion of said valve shaft including said outer ends of the radial conduits, said another portion having closure surface means which varies the effective opening area of the outer end of each of said radial conduits in a direction opposite to the direction of change of the effective opening area of the inner end thereof.

* * * * *